US009032929B2

(12) United States Patent
Inoue

(10) Patent No.: US 9,032,929 B2
(45) Date of Patent: May 19, 2015

(54) OIL SUPPLY APPARATUS OF INTERNAL COMBUSTION ENGINE

(75) Inventor: Yuta Inoue, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 13/517,346

(22) PCT Filed: Aug. 10, 2011

(86) PCT No.: PCT/JP2011/004524

§ 371 (c)(1),
(2), (4) Date: Jun. 20, 2012

(87) PCT Pub. No.: WO2013/021420

PCT Pub. Date: Feb. 14, 2013

(65) Prior Publication Data

US 2014/0190444 A1 Jul. 10, 2014

(51) Int. Cl.

| | |
|---|---|
| ***F01M 11/12*** | (2006.01) |
| ***F01M 1/16*** | (2006.01) |
| *F01M 1/18* | (2006.01) |

(52) U.S. Cl.

CPC ..... *F01M 1/16* (2013.01); *F01M 11/12* (2013.01); *F01M 2250/60* (2013.01); *F01M 1/18* (2013.01)

(58) Field of Classification Search

CPC ..... F01M 11/10; F01M 11/12; F01M 1/16; F01M 1/18; F01M 2001/0246; F01M 2001/16; F01M 2011/10; F01M 2250/60; F01M 2250/64; F01M 2250/66

See application file for complete search history.

(56) References Cited

U.S. PATENT DOCUMENTS

| | | | | |
|---|---|---|---|---|
| 5,547,349 | A * | 8/1996 | Kimura et al. | 417/282 |
| 6,155,107 | A * | 12/2000 | Liang | 73/114.56 |
| 7,011,069 | B2 | 3/2006 | Ono et al. | |
| 2010/0147256 | A1 | 6/2010 | Takahashi | |

FOREIGN PATENT DOCUMENTS

| | | |
|---|---|---|
| JP | U-62-126607 | 8/1987 |
| JP | A-2001-152826 | 6/2001 |
| JP | A-2005-140022 | 6/2005 |

(Continued)

OTHER PUBLICATIONS

International Search Report issued in International Patent Application No. PCT/JP2011/004524 dated Nov. 22, 2011 (with translation).

*Primary Examiner* — Lindsay Low
*Assistant Examiner* — Jacob Amick
(74) *Attorney, Agent, or Firm* — Oliff PLC

(57) ABSTRACT

Disclosed is an oil supply apparatus which can be realized at a low cost, and can reliably detect the lowered level of the oil filled in the oil reservoir unit. The oil supply apparatus is provided with an oil pump which is set to have a plurality of switching discharge pressures at which the oil discharge pressures are changed for each target rotation speeds when the rotation speed of the internal combustion engine reaches the respective target rotation speed. The ECU is adapted to determine that the level of oil stored in the oil pan is lowered under the condition that the deviation between the target rotation speed of the engine set to correspond to the switching discharge pressure and the rotation speed of the engine actually detected when the discharge pressure reaches the switching discharge pressure is not less than the determination value.

4 Claims, 25 Drawing Sheets

(56) References Cited

FOREIGN PATENT DOCUMENTS

| | | |
|---|---|---|
| JP | A-2005-188434 | 7/2005 |
| JP | A-2008-286063 | 11/2008 |
| JP | A-2009-180166 | 8/2009 |
| JP | A-2010-48205 | 3/2010 |
| JP | A-2010-138846 | 6/2010 |
| JP | A-2010-242527 | 10/2010 |
| JP | A-2010-242530 | 10/2010 |

* cited by examiner

OIL SUPPLY APPARATUS OF INTERNAL COMBUSTION ENGINE

TECHNICAL FIELD

The present invention relates to an oil supply apparatus of an internal combustion engine, and more particularly to an oil supply apparatus of an internal combustion engine for supplying oil to oil lubrication sections of an internal combustion engine of a vehicle to lubricate and cool the oil lubrication sections.

BACKGROUND ART

As an oil supply apparatus of an internal combustion engine to be mounted on a vehicle for supplying oil for lubricating and cooling the oil lubrication sections to oil lubrication sections of the internal combustion engine, there has so far been used an oil pump which has a variable discharge amount structure capable of suitably adjusting oil discharge pressure in response to the rotation speed of the internal combustion engine (see for example Patent Document 1).

The oil pump of this kind is generally provided with a pump body which comprises a suction port, a main discharge port, and a sub discharge port. The suction port allows the oil stored in an oil pan to be suctioned therethrough in response to the rotation of a rotor to be driven in synchronism with a crankshaft forming part of the engine, while the main discharge port and the sub discharge port permits the oil to be discharged therethrough in response to the rotor. The oil pump has a first oil passage for allowing the oil from the main discharge port to be supplied to the lubrication sections, a second oil passage for allowing the oil from the sub discharge port to be supplied to the first oil passage, and a relief passage for returning to at least one of the suction port and the oil pan the oil from a hydraulic pressure control valve provided with a valve movable in response to the pressure of the oil to the first oil passage.

The valve of the oil pump is formed with a first valve oil passage and a second valve oil passage. The valve of the oil pump is constructed to supply the oil from the sub discharge port to the first oil passage by way of the first valve oil passage when the pressure of the oil to the first oil passage is in the range of a predetermined pressure level, and on the other hand to supply the oil from the sub discharge port to the first oil passage by way of the second valve oil passage when the pressure of the oil to the first oil passage exceeds predetermined pressure level.

The oil pump constructed to enable the oil from the sub discharge port to be supplied to the first oil passage by way of the first valve oil passage when the pressure of the oil to the first oil passage is in the range of a predetermined pressure level leads to the fact that the supply amount of oil to the first oil passage is equal to an amount totaling the discharge amounts of the oil through the main discharge port and the sub discharge port, respectively, as shown by the solid line O-P in FIG. 25

If the internal combustion engine is operated to increase its rotation speed and thereby to secure a sufficient amount of oil to be supplied to the lubrication sections only with the oil passing through the main discharge port, the oil pump is operated to have a surplus amount of oil in the second oil passage not supplied to the first oil passage but returned to the relief oil passage (see the lines P-Q and Q-R in FIG. 25), resulting from the fact that the oil from the first oil passage is not required to be merged with the oil from the second oil passage.

On the other hand, the internal combustion engine operated at a high rotation speed has lubrication sections required to be supplied with a large amount of oil, i.e., a sufficient amount of oil. For this reason, the oil pump is constructed to supply the oil from the sub discharge port to the first oil passage by way of the second valve oil passage (see the line R-S in FIG. 25) when the pressure of the oil to the first oil passage exceeds predetermined pressure level.

At this time, the oil pump can have the amount of oil to be supplied to the first oil passage again totaling the discharge amounts of the oil through the main discharge port and the sub discharge port, even after the amount of oil to be supplied to the first oil passage is once only the amount of oil passing through the main discharge port.

The oil pump has an oil pressure property characterized by the oil pressure vertically increased from a changed discharge pressure R to a changed discharge pressure S when the rotation speed of the internal combustion engine is increased to a target rotation speed N3 as shown by the solid line R-S in FIG. 25.

As a consequence, the oil pump can secure a sufficient oil discharge pressure, i.e., a sufficient amount of oil required to be supplied to the lubrication sections due to the fact that the volume of oil can drastically be increased even when the internal combustion engine is operated at a high rotation speed.

The conventional oil pump has an increase rate of the oil discharge pressure of the oil pump per the rotation speed of the internal combustion engine which is varied to have a plurality of different stages (O-P, P-Q, Q-R, R-S, S-T, T-U) of discharge pressure in the rotation speed area (O-N1, N1-N2, N2-N3, N3-N4, N4-N5) as shown in FIG. 25. The conventional oil pump is controlled to have the oil discharge pressure variable in such a manner that the increase rate of the oil discharge pressure can be varied to have the plurality of different stages of discharge pressure in the rotation speed area, thereby making it possible to supply an optimum amount of oil to the lubrication sections in response to the rotation speed of the internal combustion engine.

The oil pump is set to have an increase rate of the oil discharge pressure of the oil pump variable at the plurality of different stages of discharge pressure in the rotation speed area, and enables the oil discharge pressure to be decreased to the line P-Q-R in the intermediate rotation area (N1-N3) of the internal combustion engine. This means that the oil pump can supply to the lubrication sections the amount of oil more than needed, thereby making it possible to prevent the oil pump from being applied with superfluous load increased thereto.

On the other hand, the oil stored in the oil pan is supplied to the lubrication sections by the oil pump to lubricate and cool the lubrication sections, and thereafter is collected to the oil pan. At this time, the amount of oil to be stored in the oil pan being decreased leads to the deterioration of the collection ratio of the oil to be collected in the oil pan, thereby giving rise to lowering the oil level of the oil from the optimum amount of oil to be stored in the oil pan, viz., lacking the oil in the oil pan.

The oil level lowered as previously mentioned results in the fact that there is a possibility that a strainer is brought into a state in which the strainer sucks air when allowing the oil to pass therethrough from the oil pan to the oil pump (this state being hereinafter simply referred to as "air sucking state").

The strainer held in such an air sucking state results in the reduction of the oil discharge pressure to be discharged from the oil pump, thereby giving rise to a possibility that the pump cannot supply a sufficient amount of oil to the lubrication sections, and thereby leading to deteriorating a lubrication property to the lubrication sections.

The conventional oil pump is required to promptly increase the changed discharge pressure S for example when the oil discharge pressure is changed to the changed discharge pressure R. When the air is sucked from the strainer, the changed discharge pressure R is shifted to the high rotation speed side from the rotation speed N3 of the internal combustion engine. Therefore, the rotation speed for the purpose of raising the oil discharge pressure to the changed discharge pressure R is shifted to the high rotation speed side, so that the oil pump cannot supply a sufficient amount of oil to the lubrication sections to which a large amount of oil is required to supply the oil when the internal combustion engine is operated in a high rotation speed area.

To solve the foregoing drawbacks, the conventional oil supply apparatus is constructed to detect the oil level of the oil stored in the oil pan and to monitor whether or not the oil is lowered from the desired oil level, thereby enabling the oil to be replenished if necessary.

One of the known oil supply apparatuses is provided with an oil level sensor to detect the oil level of the oil stored in the oil pan (see for example Patent Document 2). This sensor comprises a floating object, and a link mechanism, so that the sensor can detect the floating object downwardly moved together with the oil level, thereby making it possible to detect the lowering of the oil level.

An additional oil supply apparatus is known as being provided with an oil level gauge for detecting the oil level in the oil pan (see for example Patent Document 3).

The oil level gauge is attached to the internal combustion engine in a state in which the oil level gauge is inserted into a through-bore formed in the internal combustion engine, and has a leading end portion soaked in the oil stored in the oil pan.

The above known oil supply apparatus of the internal combustion engine can confirm the oil level and the state of the oil in the oil pan by watching the oil adhered to the leading end portion of the oil level gauge after the oil level gauge is removed from the internal combustion engine.

Citation List

Patent Literature

{PTL 1}

Patent Document 1: Japanese Patent Application Publication No. 2005-140022

{PTL 2}

Patent Document 2: Japanese Patent Application Publication No. 2008-286063

{PTL 3}

Patent Document 3: Japanese Patent Application Publication No. 2009-180166

SUMMARY OF INVENTION

Technical Problem

However, the conventional oil level sensor thus constructed is provided with the floating object and the link mechanism which are expensive, thereby leading to increased production cost when the expensive floating object and the link mechanism are assembled in the oil supply apparatus to detect the oil level of the oil stored in the oil pan.

As a consequence, there is a possibility that some drivers who do not carry out frequent checks of the oil level do not notice the lowered oil level.

The present invention has been made to solve the foregoing problems, and it is therefore an object of the present invention to provide an oil supply apparatus which can be realized at a low cost, and can reliably detect the lowered oil level of the oil stored in the oil reservoir unit.

Solution to Problem

In order to solve the above problems, an oil supply apparatus according to the present invention is constructed to comprise an oil supply passage that allows oil stored in an oil reservoir unit to be supplied to a plurality of lubrication sections of an internal combustion engine and recovers the oil into the oil reservoir unit, a pump unit that discharges the oil stored in the oil reservoir unit to the oil supply passage, the pump unit being controlled to have a plurality of different stages of oil discharge pressure varied in an increase amount of oil discharge pressure of the pump unit per the rotation speed of the internal combustion engine in response to the rotation speed area of the internal combustion engine, the pump unit having a plurality of switching discharge pressures each changed for each of a plurality of target rotation speeds when the rotation speeds of the internal combustion engine reach the plurality of target rotation speeds, respectively, and an abnormality determination unit being operative to set in advance the target rotation speed corresponding to an arbitrary switching discharge pressure selected from among the plurality of switching discharge pressures, and to determine that the level of oil stored in the oil reservoir unit is lowered under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value.

The oil supply apparatus according to present invention as defined in the above can allow the actual oil discharge pressure not to be raised to the oil discharge pressure equivalent to the arbitrary switching discharge pressure even at the target rotation speed of the internal combustion engine corresponding to the arbitrary switching discharge pressure when the air suction is generated because of the lowering of the level of oil stored in the oil reservoir unit and the pressure of oil discharged from the pump unit is lowered.

For this reason, the pump unit can allow the oil discharge pressure to reach the arbitrary switching discharge pressure when the rotation speed of the internal combustion engine is further raised to a rotation speed higher than the target rotation speed.

For this reason, the oil supply apparatus is constructed to comprise the pump unit having a plurality of switching discharge pressures each changed for each of a plurality of target rotation speeds when the rotation speeds of the internal combustion engine reach the plurality of target rotation speeds, respectively, and the abnormality determination unit being operative to determine that the level of oil stored in the oil reservoir unit is lowered under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value.

By the construction of the oil supply apparatus as defined in the above, the abnormality determination unit can determine that the actual rotation speed is a rotation speed within the range of error in the vicinity of the target rotation speed, thereby making it possible to determine that the actual oil discharge pressure is increased to the arbitrary switching discharge pressure when the abnormality determination unit determines the deviation between the target rotation speed of the internal combustion engine set to correspond to the arbitrary switching discharge pressure and the actual rotation speed of the internal combustion engine actually detected when the discharge pressure reaches the arbitrary switching discharge pressure is less than the determination value.

As a consequence, the oil pump can raise the oil discharge pressure, thereby making it possible to sufficiently lubricate the lubrication sections required to be supplied with a sufficient amount of oil, for example, when the internal combustion engine is operated in a high rotation speed area.

When the abnormality determination unit determines the deviation between the target rotation speed of the internal combustion engine set to correspond to the arbitrary switching discharge pressure and the actual rotation speed of the internal combustion engine actually detected when the discharge pressure reaches the arbitrary switching discharge pressure is not less than the determination value, the pump unit is operated to decrease the oil discharge pressure by the air suction. Therefore, when the actual rotation speed is higher than the target rotation speed, the actual oil discharge pressure is not raised to the arbitrary switching discharge pressure. The abnormality determination unit can determine that the level of oil stored in the oil reservoir unit is lowered.

As a consequence, the oil supply apparatus according to the present invention can dispense not only with an expensive oil sensor but also with an oil inspection work conventionally carried out by a driver. Moreover, the oil supply apparatus according to the present invention can reliably detect the lowering of the level of oil stored in the oil reservoir unit with an inexpensive construction.

The above oil supply apparatus may preferably comprise a discharge pressure detection unit that detects the oil discharge pressure discharged from the pump unit, a rotation speed detection unit that detects the rotation speed of the internal combustion engine, and the abnormality determination unit being operative to determine that the level of oil stored in the oil reservoir unit is lowered in accordance with the detection information from the discharge pressure detection unit and the rotation speed detection unit under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value.

The fact that the above oil supply apparatus comprises the discharge pressure detection unit that detects the oil discharge pressure discharged from the pump unit, and the rotation speed detection unit that detects the rotation speed of the internal combustion engine, leads to the fact that the abnormality determination unit can reliably grasp the discharge pressure of the oil discharged from the oil pump and the rotation speed of the internal combustion engine in accordance with the detection information from the discharge pressure detection unit and the rotation speed detection unit.

The above oil supply apparatus may preferably comprise an abnormality alarming unit and the abnormality determination unit being operative to output an abnormality signal to the abnormality alarming unit under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value, and the abnormality alarming unit is operative to issue an alarm when receiving the abnormality signal from the abnormality determination unit.

The oil supply apparatus according to the present invention thus constructed is operative to issue an alarm by the abnormality alarming unit when receiving the abnormal signal from the abnormality determination unit, thereby making it possible to alarm the driver the oil shortage and request the driver to refill oil in the oil reservoir unit. Further, the oil supply apparatus according to the present invention can recognize the driver of the oil shortage, thereby making it possible to prevent the internal combustion engine from being operated under the oil shortage and to prevent the lubrication capability to the lubrication sections from being deteriorated.

In the above oil supply apparatus, the abnormality determination unit may preferably be operative to estimate the variable amount of oil stored in the oil reservoir unit in accordance with the deviation.

The fact that the abnormality determination unit in the above oil supply apparatus is operative to estimate the variable amount of oil stored in the oil reservoir unit in accordance with the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure, results in the fact that the oil supply apparatus according to the present invention can dispense not only with an expensive oil level sensor but also with an oil inspection work conventionally carried out by a driver. Therefore, the oil supply apparatus according to the present invention can reliably detect the lowering of the level of oil stored in the oil reservoir unit with an inexpensive construction.

The above oil supply apparatus may preferably comprise an oil temperature detection unit that detects the temperature of oil discharged from the pump unit and the abnormality determination unit being operative to change the arbitrary switching discharge pressure in response to the target rotation speed of the internal combustion engine in accordance with the temperature of oil discharged from the pump unit.

The reason is due to the fact that the viscosity of the oil discharged from the pump unit is decreased in response to the increased temperature, and thus the amount of oil leakage is increased at the lubrication sections to be supplied with the oil, thereby decreasing the ratio of the increase of the oil discharge pressure with respect to the increase of the rotation speed of the internal combustion engine, so that the switching discharge pressure of the oil discharge pressure with respect to the temperature of the oil can be varied in response to the target rotation speed of the internal combustion engine.

Therefore, the abnormality determination unit can preliminarily change the arbitrary switching discharge pressure in response to the target rotation speed of the internal combustion engine in accordance with the temperature of oil discharged from the pump unit, and thereby can set an optimum arbitrary switching discharge pressure in response to the target rotation speed of the internal combustion engine in accordance with the temperature of oil discharged from the pump unit, so that the abnormality determination unit can detect at a high accuracy the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure. As a result, the above oil supply apparatus can determine that the level of oil stored in the oil reservoir unit is lowered at a high accuracy.

In the above oil supply apparatus, the abnormality determination unit may preferably be operative to calculate the arbitrary switching discharge pressure and the target rotation speed corresponding to the arbitrary switching discharge pressure in accordance with the detection information from the oil temperature detection unit, and to determine that the level of oil stored in the oil reservoir unit is lowered under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value.

The above oil supply apparatus is constructed to have the abnormality determination unit calculate the arbitrary switching discharge pressure set in response to the temperature of the oil and the target rotation speed corresponding to the arbitrary switching discharge pressure, and to determine that the level of oil stored in the oil reservoir unit is lowered in accordance with the calculation information thus obtained, so that the oil supply apparatus can detect at a high accuracy the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure. As a result, the above oil supply apparatus can determine that the level of oil stored in the oil reservoir unit is lowered at a high accuracy.

Advantageous Effects of Invention

The present invention can provide an oil supply apparatus which can be constructed at a low cost, and can reliably detect the lowered oil level of the oil stored in the oil reservoir unit.

DESCRIPTION OF EMBODIMENTS

One embodiment of an oil supply apparatus of an internal combustion engine according to the present invention will be explained hereinafter with reference to the accompanying drawings.

FIGS. 1 to 24 show the one embodiment of the oil supply apparatus of the internal combustion engine according to the present invention.

First, the construction of the embodiment will be described hereinafter.

Figure 1:
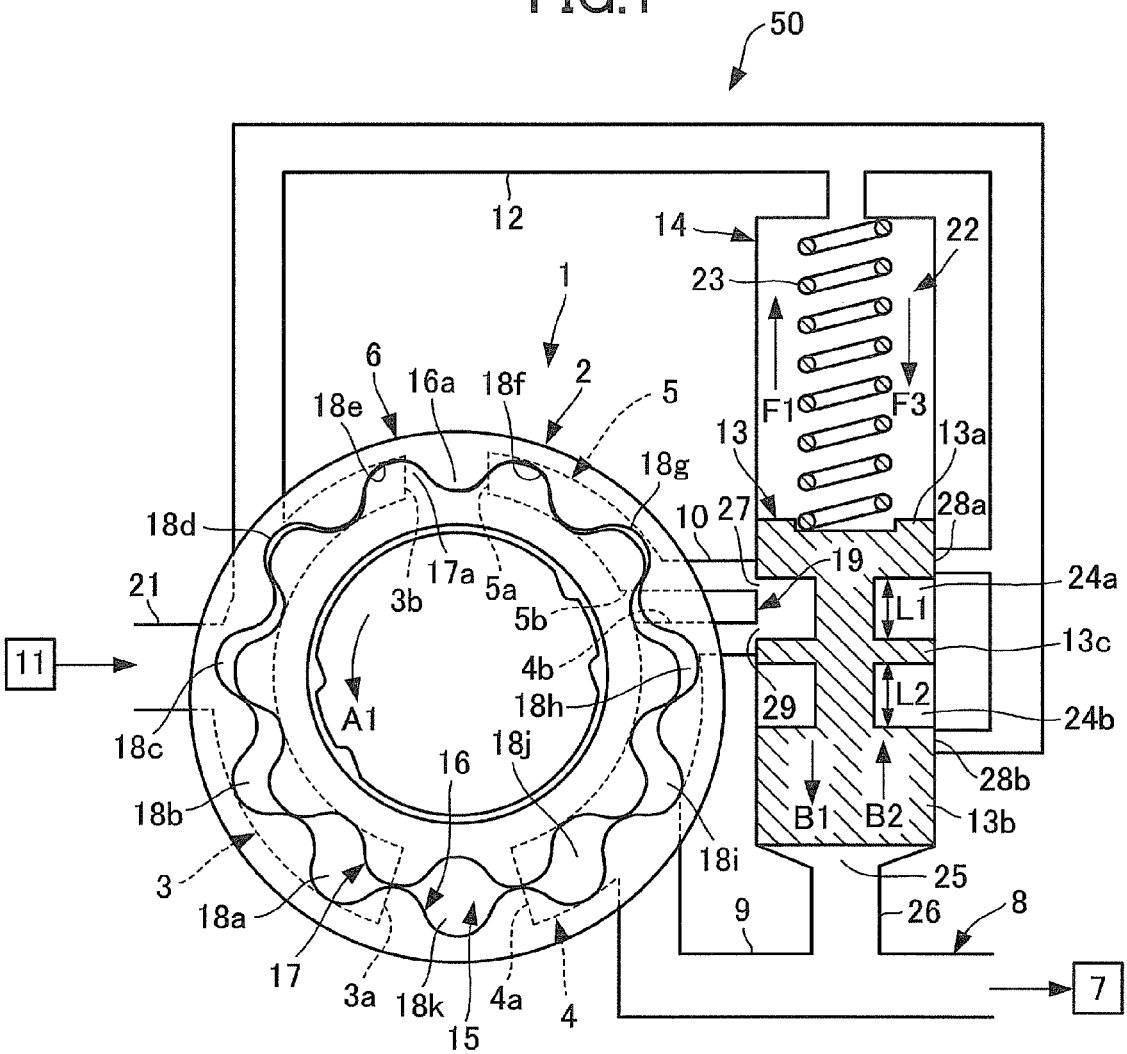
FIG. 1 is one embodiment of an oil supply apparatus of an internal combustion engine according to the present invention, and a schematic construction view showing an oil pump provided in an oil supply apparatus of an internal combustion engine.
Figure 2:
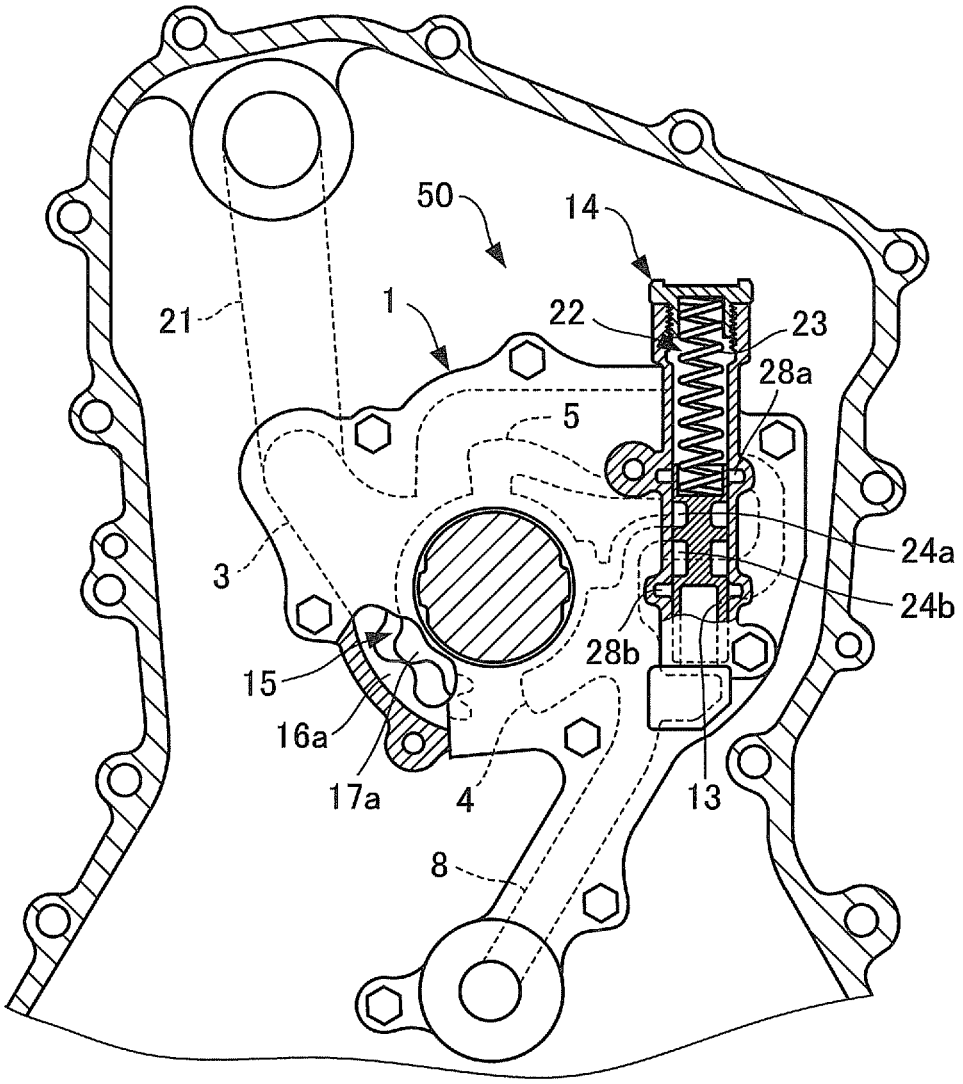
FIG. 2 is one embodiment of the oil supply apparatus of the internal combustion engine according to the present invention, and a schematic construction view showing an oil pump mounted on an internal combustion engine

In FIGS. 1, 2, an oil pump 1 serving as an oil unit is provided with a pump body 6 having a suction port 3, a main discharge port 4, and a sub discharge port 5 formed therein. The suction port 3 is adapted to suck oil in response to the rotation of a rotor 2 driven in synchronism with a crankshaft forming part of an internal combustion not shown in the drawings. The main discharge port 4 and the sub discharge port 5 function to discharge the oil in response to the rotation of the rotor 2.

The oil pump 1 is provided with a supply oil passage 8 supplying oil to a lubricating section 7, a first oil passage 9 supplying oil from at least the main discharge port 4 to the supply oil passage 8, a second oil passage 10 supplying oil from the sub discharge port 5 to the supply oil passage 8 through the first oil passage 9, a return oil passage 12 returning oil from the sub discharge port 5 to at least one of the suction port 3 and the oil pan 11 as an oil reservoir unit, and a hydraulic pressure control valve 14 having a valve body 13. The valve body 13 connects the second oil passage 10 and at least one of the first oil passage 9 and the return oil passage 12 by operating in response to the hydraulic pressure of oil to the supply oil passage 8.

The pump body 6 is made of metals (for example aluminum alloy, iron-based alloy) and has an inner portion formed with a pump chamber 15. The pump chamber 15 is constructed to accommodate therein an outer rotor 16 formed with a large number of inner teeth 16*a* to constitute a driven gear, and an inner rotor 17 formed with a large number of outer teeth 17*a* to constitute a drive gear. The rotor 2 in the present embodiment is constituted by the outer rotor 16 and the inner rotor 17.

The inner rotor 17 is connected with the crankshaft forming part of the internal combustion engine serving as a driving source and thus is adapted to rotate together with the crankshaft. This means that the oil pump 1 in the present embodiment is of a type directly connected with the crankshaft of the internal combustion engine. The inner teeth 16*a* and the outer teeth 17*a* are specified with a trochoid curve or cycloid curve, etc.

The rotor 2 is adapted to be rotated in the direction shown by an arrow A1 to have the inner rotor 17 rotated. In response to the rotation of the inner rotor 17, the outer teeth 17*a* of the inner rotor 17 are brought into meshing engagement with the inner teeth 16*a* of the outer rotor 16, then the outer rotor 16 is being rotated in the same direction of the inner rotor 17.

The rotor 2 has spaces 18*a* to 18*k* formed by the outer teeth 17*a* of the inner rotor 17 and the inner teeth 16*a* of the outer rotor 16 between the outer teeth 17*a* and inner teeth 16*a*. The space 18*k* has the largest volume while each of the spaces 18*e* and the 18*f* has the smallest volume. For example, the rotor 2 is gradually increased in volume from the space 18*e* toward the space 18*a* to generate a suction pressure, viz., to acquire an oil suction effect, while the rotor 2 is gradually decreased in volume from the space 18*j* toward the space 18*f* to generate a discharge pressure, viz., to acquire an oil discharge effect.

Each of the main discharge port 4 and the sub discharge port 5 of the pump body 6 forms a port through which the oil is discharged from the pump chamber 15 in response to the rotation of the rotor 2. The main discharge port 4 has end faces 4*a*, 4*b*, while the sub discharge port 5 also has end faces 5*a*, 5*b*.

Similarly, the suction port 3 of the pump body 6 forms a port through which the oil is sucked into the pump chamber 15 in response to the rotation of the rotor 2. The suction port 3 also has end faces 3*a*, 3*b*.

In the present embodiment, the main discharge port 4 is positioned at the upstream side of the sub discharge port 5 in the rotation direction of the rotor 2 shown by the arrow A1. The opening area of the main discharge port 4 is set to be large compared with the opening area of the sub discharge port 5.

The main discharge port 4 and the sub discharge port 5 are separated from each other by a partition portion 19, so that the main discharge port 4 and the sub discharge port 5 have respective discharge functions independent from each other. The width of the partition portion 19 is set to be smaller than the width of the teeth positioned between the main discharge port 4 and the sub discharge port 5 to prevent the oil pressure in the space formed between the neighboring two teeth from being raised due to the fact that the oil is closed and sealed by the inner teeth 16*a* and the outer teeth 17*a* in a compression step of the spaces formed by the inner teeth 16*a* and the outer teeth 17*a* in response to the rotation of the rotor 2.

The supply oil passage 8 is an oil passage for supplying the oil to the lubrication sections 7, and constitutes part of an oil supply passage 20 which will become apparent as the description proceeds.

The first oil passage 9 has the main discharge port 4 held in communication with the supply oil passage 8 to allow the oil discharged from the main discharge port 4 to be supplied to the supply oil passage 8

The second oil passage 10 also has the supply oil passage 8 held in communication with the sub discharge port 5 to allow the oil discharged from the sub discharge port 5 to be supplied to the supply oil passage 8 through the first oil passage 9. The embodiment is raised in FIG. 1 as an example that the oil discharged from the sub discharge port 5 is supplied to the supply oil passage 8 through the first oil passage 9 after passing through the hydraulic pressure control valve 14 and the main discharge port 4.

The return oil passage 12 forms an oil passage for allowing the oil discharged from the sub discharge port 5 to be returned to at least either one of the suction port 3 and the oil pan 11. The suction port 3 is held in communication with a suction passage 21 through which the oil is sucked from the oil pan 11.

The hydraulic pressure control valve 14 is provided with a valve body 13 activated in response to the oil pressure of the oil to the supply oil passage 8, and formed with a valve chamber 22 serving as a space allowing the valve body 13 to be slidable therein. The valve body 13 is received in the valve chamber 22 to be urged by a compression coil spring 23 in a direction shown by an arrow B1. The valve body 13 has axial end portions respectively formed with a first valve portion 13*a* and a second valve portion 13*b* which forms a first valve chamber 24*a* and a second valve chamber 24*b*, respectively. The first valve chamber 24*a* and the second valve chamber 24*b* constitute in combination an oil accommodation portion for accommodating the oil in the hydraulic pressure control valve 14.

The valve body 13 has a division portion 13*c* for dividing the oil accommodation portion into the first valve chamber 24*a* and the second valve chamber 24*b*.

The hydraulic pressure control valve 14 is provided with a first valve port 25 which is held in communication with the first oil passage 9 and the supply oil passage 8 through an intermediate oil passage 26. The hydraulic pressure control valve 14 is adapted to have the first valve port 25 held in communication with the first oil passage 9, thereby making it possible to transmit the oil pressure of the oil to the valve body 13 through the first oil passage 9.

The hydraulic pressure control valve 14 is further provided with a second valve port 27 which is communicable with the second oil passage 10. This means that the hydraulic pressure control valve 14 can have the oil from the sub discharge port 5 introduced into the first valve chamber 24*a* and the second valve chamber 24*b* when the second valve 27 is brought into communication with the second oil passage 10.

The hydraulic pressure control valve 14 is further provided with return ports 28*a*, 28*b* which are communicable with the return oil passage 12, and is operative to have the oil from the hydraulic pressure control valve 14 returned to the suction port 3 when the return ports 28*a*, 28*b* are brought into communication with the return oil passage 12.

The hydraulic pressure control valve 14 is further provided with a junction port 29 held in communication with the main discharge port 4 to supply the oil from the hydraulic pressure control valve 14 to the main discharge port 4.

Figure 3:
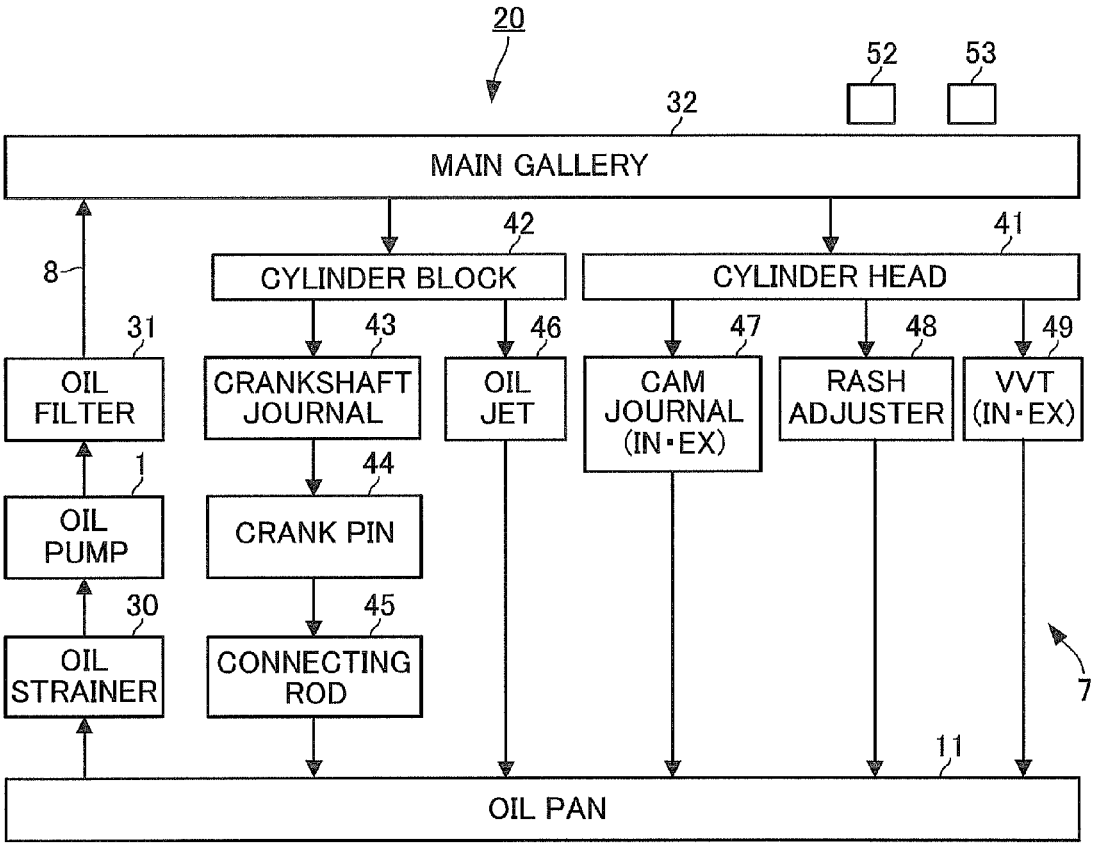
FIG. 3 is one embodiment of the oil supply apparatus of the internal combustion engine according to the present invention, and shows oil supply passages and lubrication sections provided on the oil supply passages.
Figure 4:
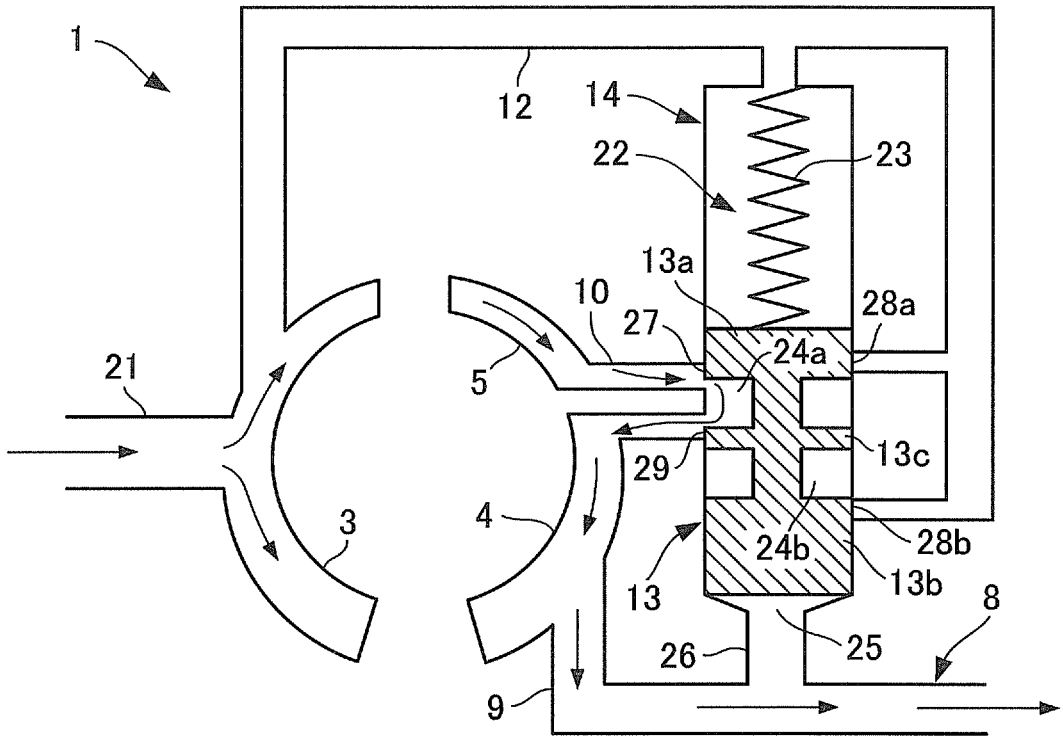
FIG. 4 is one embodiment of the oil supply apparatus of the internal combustion engine according to the present invention, and a schematic construction view showing an oil pump type A.

On the other hand, the supply oil passage 8 is held in communication with an oil supply passage unit 20 which is, as shown in FIG. 3, constructed to have a plurality of pipes and passages serving to supply the oil stored in the oil pan 11 to each of the lubrication sections and thereafter to be returned to the oil pan 11.

The oil supply passage unit 20 is constructed to allow the oil stored in the oil pan 11 and pumped up by the oil pump 1 to be supplied to each of the lubrication sections 7 of the internal combustion engine to cool and lubricate the lubrication sections 7.

The oil functions not only to lubricate the lubrication sections 7 but also to absorb heat such as friction heat generated from the lubrication sections 7 before being returned to the oil pan 11.

More specifically, an oil strainer 30 has a suction opening soaked in the oil pan 11 and is adapted to filter the oil stored in the oil pan 11. The oil stored in the oil pan 11 is designed to be pumped up by the oil pump 1 and discharged to the supply oil passage 8 from the oil pump 1. The supply oil passage 8 is provided with an oil filter 31 which is adapted to remove foreign objects in the oil.

At the downstream portion of the supply oil passage 8 is provided a main gallery 32 extending along the crankshaft in the wall surface of a cylinder block 42. The main galley 32 is branched to a cylinder head 41 and the cylinder block 42 to supply the oil discharged from the oil pump 1 to the cylinder head 41 and the cylinder block 4.

The oil branched and supplied to the cylinder head 41 and the cylinder block 42 is supplied to the various parts and elements limning the internal combustion engine.

For example, the oil in the cylinder block 42 is used as lubrication oil for a crankshaft journal 43, a crank pin 44, a connecting rod 45, and the like, and as operation oil for an oil jet 46 serving as an injection unit. The oil in the cylinder head 41 is used as lubrication oil for a cam journal 47 and the like and as operation oil for a rash adjuster 48 and a VVT (Variable Valve Timing-intelligent) 49.

That means the lubrication sections 7 include a crankshaft journal 43, a crank pin 44, a connecting rod 45, an oil jet 46, a cam journal 47, a rash adjuster 48 and a VVT 49.

Here, the oil jet 46 is adapted to inject the oil toward the bottom surface of a piston not shown of the internal combustion engine to cool the piston exposed to burning gases and heightened in heat load, thereby preventing abnormal burning from being generated for example at a high load operation time of the internal combustion engine, and thus suppressing a knocking phenomenon.

The VVT 49 indicates an intake and exhaust variable valve mechanism which is adapted to control intake valves and exhaust valves not shown at optimum opening and closing timings in response to the operation of the internal combustion engine. The VVT 49 is constructed to have the intake cam shaft and the exhaust cam shaft and a VVT controller provided at the axial end portion of the exhaust cam shaft.

The VVT 49 is operative to change the phase of the cam shaft to the cam sprocket by transmitting the oil pressure from the oil control valve to an advance angle chamber and a retard angle chamber of the VVT controller, thereby advancing or retarding the timing of opening and closing of the intake valve and the exhaust valve.

Here, the oil pump 1, the oil supply passage unit 20, and the oil pan 11 in the present embodiment constitute as a whole an oil supply apparatus 50 according to the present invention.

The oil pump 1 in the present embodiment is operative to have the valve body 13 of the hydraulic pressure control valve 14 assume following different stages A to E in response to the increased rotation speed of the rotor 2, viz., the rotation speed of the internal combustion engine. The oil pump 1 in the present embodiment is set to have a first rotation area, a second rotation area, and a third rotation area in order from the lower in rotation speed of the internal combustion engine.

Here, the rotation speed of the internal combustion engine indicates a rotation speed of the crankshaft which is the same as that of the rotor 2.

The Stage A (First Rotation Area)

The oil pump 1 is constructed to supply the oil to the supply oil passage 8 by the oil pressure of the oil discharged into the first oil passage 9 from the main discharge port 4 and the sub discharge port 5 in the case of a small rotation speed of the internal combustion engine immediately after the start of the internal combustion engine.

Further, the oil pump 1 is operative to have the oil pressure act on the valve body 13 through the intermediate oil passage 26 and the first valve port 25 of the hydraulic pressure control valve 14, thereby generating a valve body driving force F1 for driving the valve body 13. When the valve body driving force F1 is smaller than the urging force F3 of the compression spring 23 (F1<F3), the valve body 13 is moved by the compression coil spring 23 in the direction shown by an arrow B1 (see FIG. 1). At this time, the oil pump 1 takes a state in which the first valve portion 13*a* of the valve body 13 closes the return port 28*a*, the second valve portion 13*b* of the valve body 13 closes the return port 28*b* while the second valve port 27 and the junction port 29 are held in communication with each other (see FIG. 4).

For this reason, the oil from the sub discharge port 5 is supplied to the supply oil passage 8 through the first valve chamber 24*a* and the first oil passage 9. This means that the oil discharge pressure of the oil to the supply oil passage 8, in the stage A, becomes equal to the oil pressure being generated by the total amount of the oil passing through the main discharge port 4 and the oil passing through the sub discharge port 5 as shown by the dotted line L1 in FIG. 9.

Figure 9:
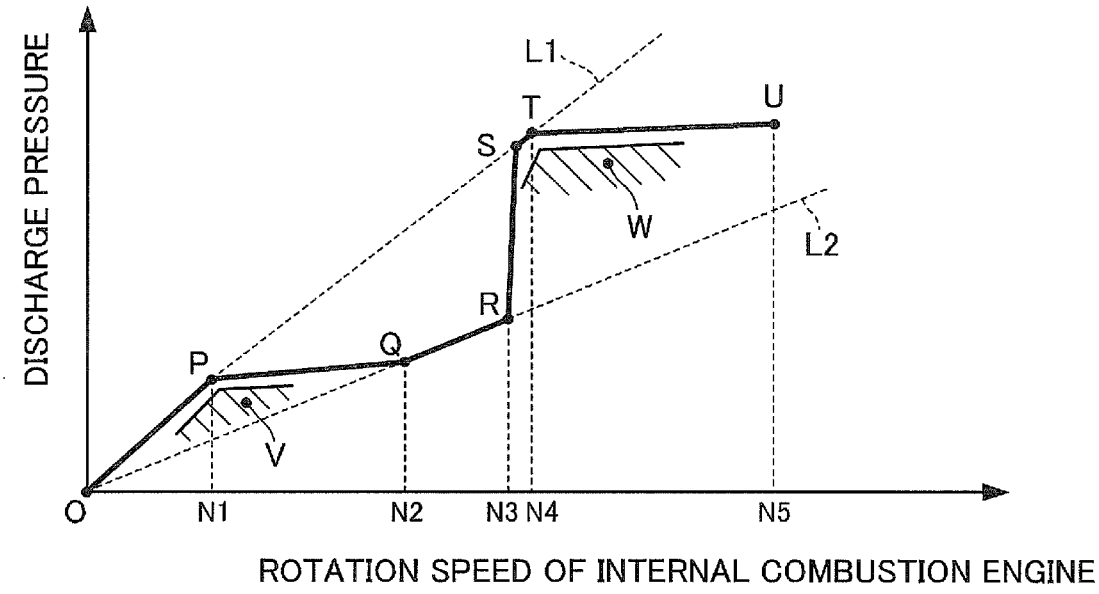
FIG. 9 is one embodiment of the oil supply apparatus of the internal combustion engine according to the present invention, and shows the relationship between the rotation speed of the internal combustion engine with oil temperature in a high temperature area, and an oil discharge pressure.
Figure 10:
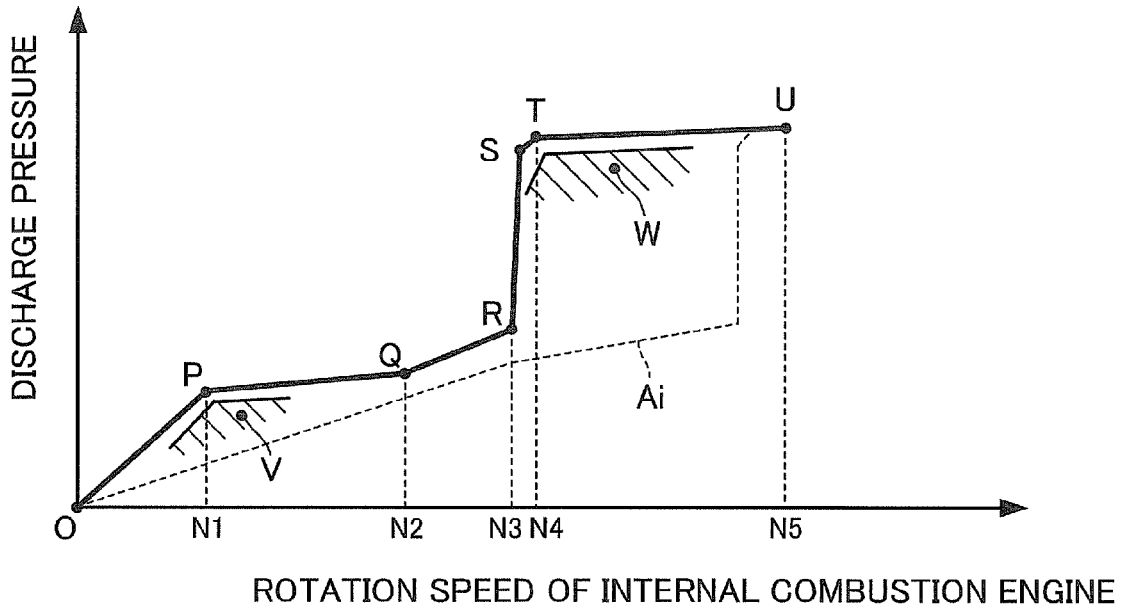
FIG. 10 is one embodiment of the oil supply apparatus of the internal combustion engine according to the present invention, and shows the relationship between the rotation speeds of the internal combustion engines with no air suction generated and with air suction generated, and oil discharge pressures

At this time, the discharge pressure of the oil discharged to the supply oil passage 8 has a property as shown by the solid line O-P shown in FIG. 9. More specifically, the property is acquired to have the oil discharge amount from the main discharge port 4 increased and the oil pressure of the oil in the first oil passage 9 increased, and to have the oil discharge amount from the sub discharge port 5 and the oil pressure of the oil in the second oil passage 10 increased in response to the increased rotation speed of the internal combustion engine.

The Stage B (First Rotation Area)

When the rotation speed of the internal combustion engine is increased to exceed the rotation speed N1, thereby causing the valve body driving force F1 to be increased to have a force larger than the urging force F3 of the compression coil spring 23 (F1>F3), the valve body 13 is moved in a direction shown by an arrow B2 in FIG. 1 until the valve body driving force F1 is balanced with the urging force F3.

Figure 5:
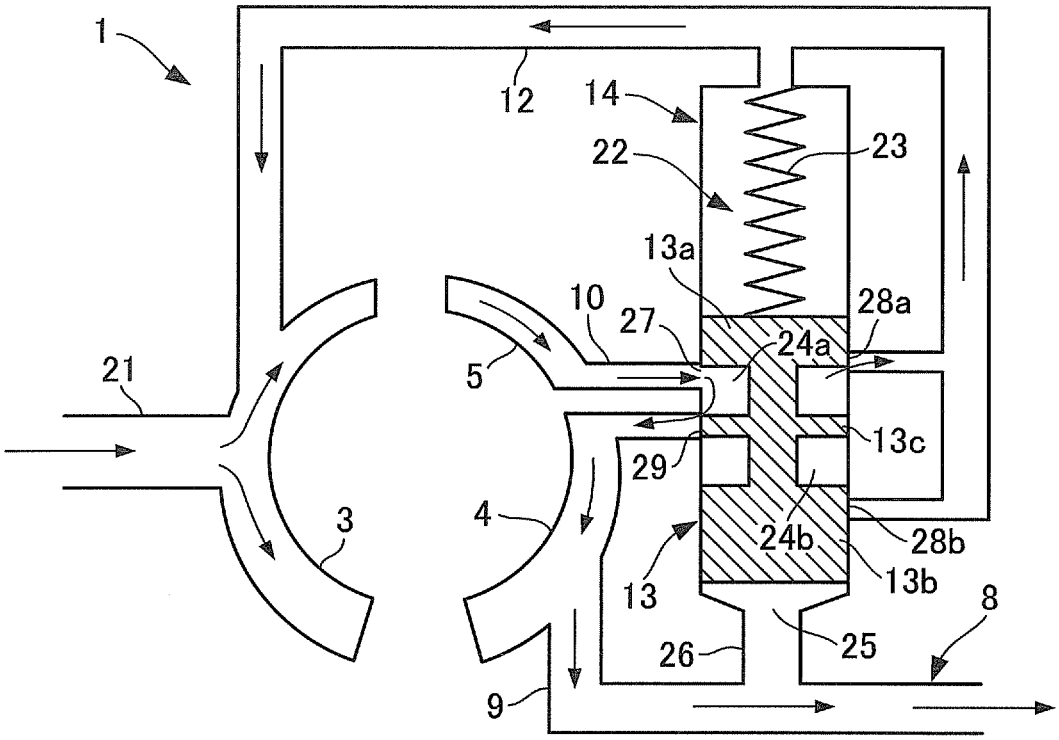
FIG. 5 is one embodiment of the oil supply apparatus of the internal combustion engine according to the present invention, and a schematic construction view showing an oil pump type B.

At this time, the valve body 13 takes a position where the second valve port 27 and the junction port 29 are held in communication with each other, and the return port 28*a* is released by the first valve portion 13*a* from being closed as shown in FIG. 5. This means the valve body 13 takes an intermediate state to be transferred to the stage C which will be described hereinafter in more detail. At this time, the oil from the sub discharge port 5 is partly supplied to the return oil passage 12 through the first valve chamber 24*a*, and partly supplied to the supply oil passage 8 through the first oil passage 9.

The supply amount of oil to the supply oil passage 8 becomes equal to the total of the discharge amount of oil passing through the main discharge port 4 and the discharge amount of oil passing through the sub discharge port 5. At this time, the discharge pressure of the oil discharged to the supply oil passage 8 has a property as shown by the solid line P-Q in FIG. 9, characterized by the fact that the rate of the increased discharge amount with respect to the increased rotation speed of the internal combustion engine is decreased since the first valve chamber 24*a* is held in communication with the return oil passage 12.

Here, the relationship between the oil pressure necessary for the VVT 49 as one of the lubrication sections 7 and the rotation speed of the internal combustion engine will be raised as one of the example for explanation as follows. For example, it is necessary for the internal combustion engine to have an oil pressure roughly equivalent to the total discharge amount of the discharge amount of oil passing through the main discharge port 4 and the discharge amount of oil passing through the sub discharge port 5 immediately after the start of the internal combustion engine. The total discharge amount is, however, not required by the internal combustion engine when the rotation speed of the rotor exceeds a predetermined rotation speed (N1). In other words, the necessary oil can be secured only with the discharge amount of oil passing through the main discharge port 4 (see the area shown by "V" in FIG. 9). It is therefore preferable that the oil pump 1 is constructed to have such a property that the respective inclinations O-P and P-Q in FIG. 9 are over the required oil pressure V of the VVT.

The Stage C (Second Rotation Area)

When the rotation speed of the internal combustion engine is further increased to the rotation speed no less than N2, the valve body 13 is further moved in the direction shown by the arrow B2 in FIG. 1.

Figure 6:
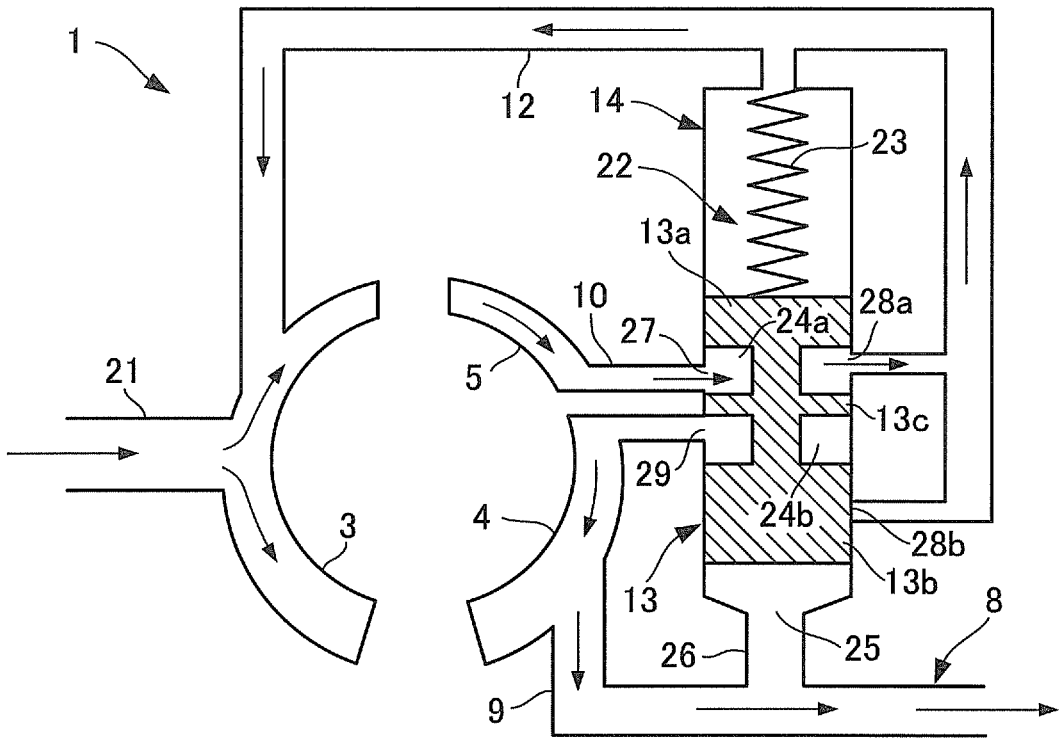
FIG. 6 is one embodiment of the oil supply apparatus of the internal combustion engine according to the present invention, and a schematic construction view showing an oil pump type C.

At this time, the valve body 13 takes a position where the second valve port 27 and the junction port 29 are held out of communication with each other, and the return port 28*a* is completely released by the first valve portion 13*a* of the valve body 13 from being closed as shown in FIG. 6.

Under these conditions, the oil pump 1 is operative to have the oil from the main discharge port 4 supplied to the supply oil passage 8, and to have the oil from the sub discharge port 5 supplied to the return oil passage 12 through the first valve chamber 24*a* when the oil pressure of the oil to be supplied to the supply oil passage 8 is increased.

At this time, the discharge pressure of the oil discharged to the supply oil passage 8 has a property as shown by the solid line Q-R in FIG. 9. In the stage C, the discharge pressure of the oil discharged to the supply oil passage 8 comes to be equal to the discharge pressure of the oil passing through the main discharge port 4 as shown by the dotted line L2 in FIG. 9.

The Stage D (Third Rotation Area)

When the rotation speed of the internal combustion engine is further increased to the rotation speed no less than N3, the valve body 13 is further moved in the direction shown by the arrow B2 in FIG. 1.

Figure 7:
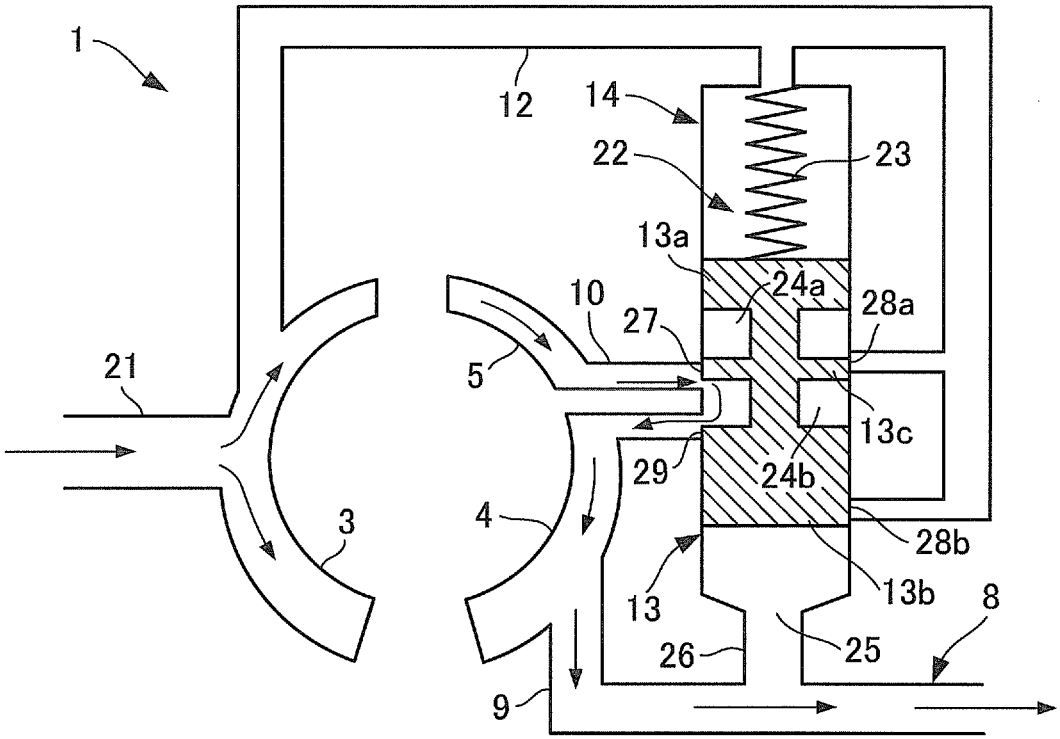
FIG. 7 is one embodiment of the oil supply apparatus of the internal combustion engine according to the present invention, and a schematic construction view showing an oil pump type D.

At this time, the valve body 13 takes a position where the second valve port 27 and the junction port 29 are held in communication with each other, and the division portion 13*c* hinders the oil from being supplied to the return port 28*a* as shown in FIG. 7. For this reason, the oil from the sub discharge port 5 is thus supplied to the supply oil passage 8 through the second valve chamber 24*b* and the first oil passage 9.

In the stage D, the supply amount of oil to the supply oil passage 8 again comes to be the total amount of the discharge amount of oil passing through the main discharge port 4 and the discharge amount of oil passing through the sub discharge port 5. At this time, the discharge pressure of the oil discharged to the supply oil passage 8 has a property as shown by the solid line R-T in FIG. 9.

In this way, the valve body 13 is operative to change to the supply oil passage 8 the destination of the oil previously transferred to the return port 28*a* in order to stop the transfer of the oil to the return port 28*a* after the second valve port 27 and the junction port 29 are brought into communication with each other.

As a consequence, the discharge pressure of the oil discharged to the supply oil passage 8 is increased (the solid line R-S in FIG. 9), and thereafter the amount of oil discharged from the supply oil passage 8 comes to be the total amount of the discharge amount of oil passing through the main discharge port 4 and the discharge amount of oil passing through the sub discharge port 5 (the solid line S-T in FIG. 9).

The Stage E (Third Rotation Area)

When the rotation speed of the internal combustion engine is further increased to the rotation speed no less than N4, the valve body 13 is further moved in the direction shown by the arrow B2 in FIG. 1.

Figure 8:
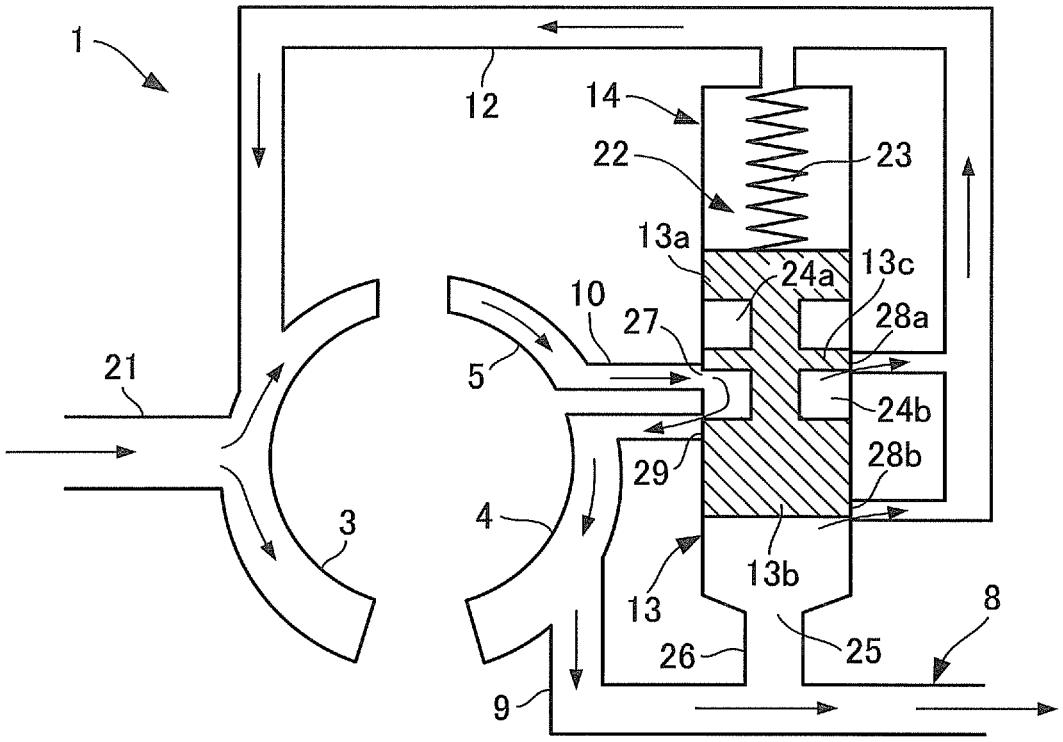
FIG. 8 is one embodiment of the oil supply apparatus of the internal combustion engine according to the present invention, and a schematic construction view showing an oil pump type E.

At this time, the valve body 13 takes a position where the second valve port 27 and the junction port 29 are held in communication with each other, and the return port 28*b* is released by the second valve portion 13*b* from being closed as shown in FIG. 8. Then, the valve body 13 releases the return port 28*a* from being closed by the division portion 13*c*.

As a consequence, the oil from the sub discharge port 5 is supplied to the return oil passage 12 through the second valve chamber 24*b* and the return port 28*a*, while the oil from the main discharge port 4 is also supplied to the return oil passage 12 through the return port 28*b*.

That means, in the stage E, the discharge amount of oil discharged from the oil pump 1 comes to be the total amount of the discharge amount of oil partly passing through the main discharge port 4 and the discharge amount of oil partly passing through the sub discharge port 5. At this time, the discharge pressure of the oil discharged to the supply oil passage 8 has a property as shown by the solid line T-U in FIG. 9, characterized by the fact that the rate of the increased oil discharge pressure with respect to the increased rotation speed of the internal combustion engine is decreased since the first valve chamber 24*b* is held in communication with the return oil passage 12. Here, the relationship between the oil pressure necessary for the oil jet 46, one of the lubrication sections 7, and the rotation speed of the internal combustion engine will be raised as one of the example for explanation as follows.

For example, it is necessary for the internal combustion engine to have an oil pressure roughly equivalent to the total discharge amount totaling the discharge amount of oil passing through the main discharge port 4 and the discharge amount of oil passing through the sub discharge port 5 in the vicinity of the high rotation area of the internal combustion engine. However, the total discharge amount is not required when the rotation speed of the internal combustion engine exceeds a predetermined rotation speed (N4) (see the area shown by "W" in FIG. 9). It is therefore preferable that the oil pump 1 is constructed to have such a property that the inclination T-U is over the required oil pressure W of the oil jet 46.

It will be understood from the foregoing description that the oil pump 1 is constructed to enable the oil from the sub discharge port 5 to be supplied to the supply oil passage 8 through the first valve chamber 24*a* and the first oil passage 9 when the rotation speed of the internal combustion engine is in the first rotation area. At this time, the supply amount of oil to the supply oil passage 8 comes to be the total amount of the discharge amount of oil passing through the main discharge port 4 and the discharge amount of oil passing through the sub discharge port 5 (the solid lines O-P, P-Q in FIG. 9).

In the second rotation area where the rotation speed of the internal combustion engine is increased, the discharge pressure of the oil discharged from the main discharge port 4 is increased, and thus the necessary oil pressure of the supply oil passage 8 can be secured only with the discharge amount of oil passing through the main discharge port 4, whereupon it is not required to merge the oil from the first oil passage 9 and the oil from the second oil passage 10 (the solid line Q-R in FIG. 9).

In the case that the necessary oil pressure can be secured only with the discharge amount of oil passing through the first oil passage 9, the surplus oil in the second oil passage 10 is not required to be supplied to the supply oil passage 8 but is returned to the return oil passage 12 through the first valve chamber 24*a*. In this way, the surplus oil does not have a large oil pressure.

When, on the other hand, the internal combustion engine is in the high rotation area (third rotation area), it is required to promptly supply a large amount of oil to the piston in the lubrication sections 7, for example, an oil jet 46 and the like.

For this reason, the oil pump 1 is operative to rapidly increase the oil discharge pressure from R to S in the third rotation area as shown in FIG. 9, and to have the oil from the sub discharge port 5 supplied to the supply oil passage 8 through the second valve chamber 24*b* and the first oil passage 9. At this time, the supply amount of oil to the supply oil passage 8 can be equal to the total amount of the discharge amount of oil through the main discharge port 4 and the discharge amount of oil through the sub discharge port 5 (the solid line S-T in FIG. 9).

This leads to the fact that the oil pump 1 can again increase the volume of the oil to be supplied to the supply oil passage 8 in the high speed area of the rotation speed of the rotor, thereby making it possible to reliably secure the amount of oil necessary to be supplied to the supply oil passage 8.

Figure 25:
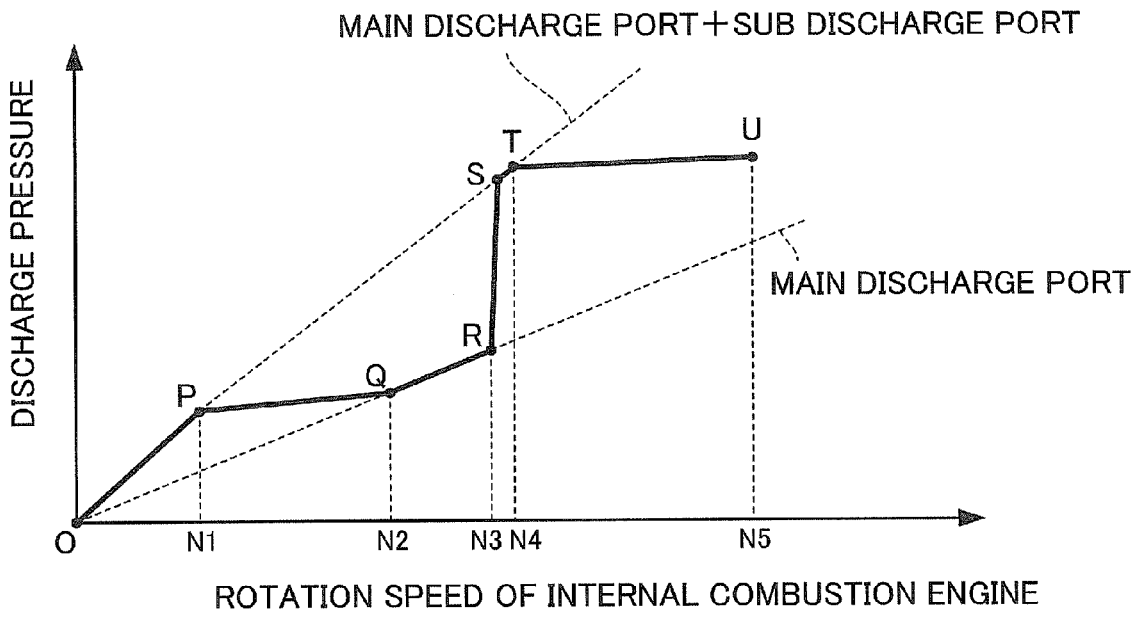
FIG. 25 is one embodiment of the oil supply apparatus of the internal combustion engine according to the present invention, and shows the relationship between the rotation speed of the internal combustion engine with an oil pump constructed to have a variable discharge amount of oil, and an oil discharge pressure of the oil pump.

In this way, the oil pump 1 according to the present embodiment is controlled to have the plural stages of the oil discharge pressure variable in such a manner that the increase rate of the oil discharge pressure of the oil pump per the rotation speed of the internal combustion engine can be varied to have a plurality of different stages A to E (O-P, P-Q, Q-R, R-S, S-T, T-U) of discharge pressure in response to the rotation speed areas (0-N1, N1-N2, N2-N3, N3-N4, N4-N5) as shown in FIG. 25.

In particular, the oil pump 1 according to the present invention has a property characterized by the oil discharge pressure roughly vertically increased as shown by the discharge pressure S increased immediately after the discharge pressure R when the rotation speed of the internal combustion engine reaches the rotation speed N3 in the area R-S in which the changing rate of the oil discharge pressure is largest among the plurality of stages of the oil discharge pressure shown by the stages A to E.

When the level of oil stored in the oil pan 11 is lowered, there is generated a phenomenon what is called an air suction in which air is sucked from the suction opening of the oil strainer 30.

The oil pump 1 according to the present invention is required to change the oil discharge pressure to the switching discharge pressure R and to promptly increase the oil discharge pressure to the switching discharge pressure S when the rotation speed of the internal combustion engine reaches the target rotation speed N3. When the air suction is generated, the discharge pressure of the oil discharged from the oil pump 1 is decreased to have the changed discharge pressure R shifted to the high rotation speed side from the rotation speed N3 of the internal combustion engine as shown by the virtual line Ai in FIG. 10.

Therefore, the rotation speed of the internal combustion engine to be changed from the switching discharge pressure R to the switching discharge pressure S is also shifted to the high rotation speed side, and thus the oil pump cannot supply a sufficient amount of oil to the oil jet 46 to which a large amount of oil is required to supply the oil, and cannot sufficiently lubricate the piston when the internal combustion engine is operated in a high rotation speed area.

The oil pump 1 according to the present invention is constructed to have such a property to have the oil discharge pressure increased to the switching discharge pressure S from the switching discharge pressure R starting the increase of the oil discharge pressure, when the rotation speed of the internal combustion engine reaches the target rotation speed.

The oil supply apparatus 50 according to the present embodiment is adapted to determine whether or not the oil level is lowered in accordance with the switching discharge pressure R, i.e., an arbitrary switching discharge pressure, and the rotation speed of the internal combustion engine, thereby making it possible to require no expensive oil level gauges and no oil inspection work by oil level gauges.

The following explanation will be directed to a concrete construction of the oil supply apparatus 50 for determining the lowering of the oil level.

Figure 11:
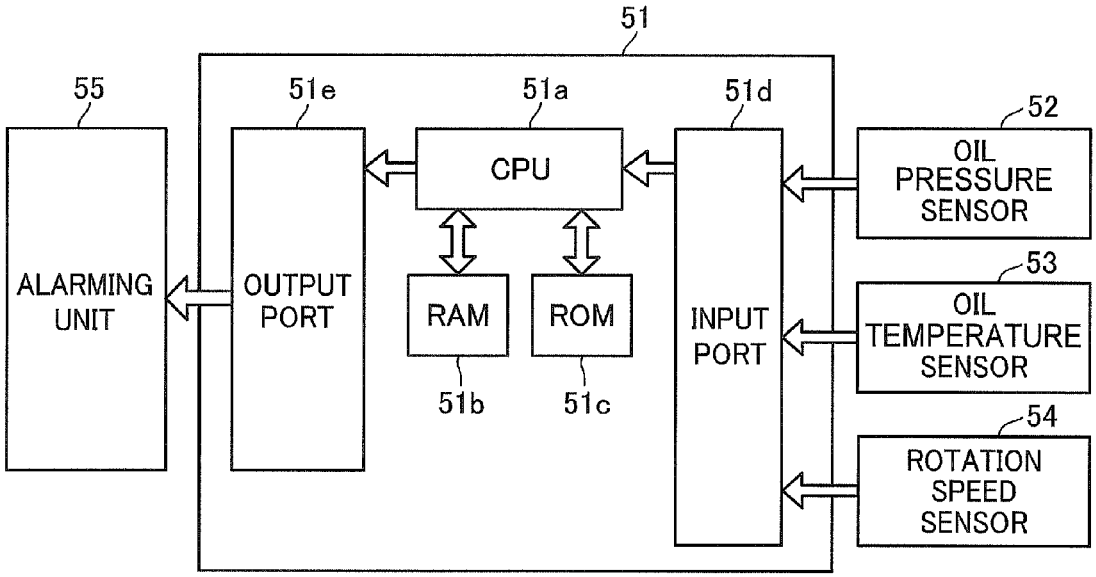
FIG. 11 is one embodiment of the oil supply apparatus of the internal combustion engine according to the present invention, and shows a circuit construction of an oil pump apparatus.

The oil supply apparatus 50 is shown in FIG. 11 as being provided with an ECU (Electronic Control Unit) 51 constituting an abnormality detection unit, an oil pressure sensor 52 constituting an oil pressure detection unit, an oil temperature sensor 53 constituting an oil temperature detection unit, and a rotation speed sensor 54 constituting a rotation speed detection unit.

The ECU 51 is constructed to include a CPU (Central Processing Unit) 51*a*, RAM (Random Access Memory) 51*b*, ROM (Read Only Memory) 51*c*, an input port 51*d*, and an output port 51*e*.

The CPU 51*a* is adapted to execute an abnormality determination process for determining whether or not the oil level is lowered in accordance with a target rotation speed determination map, an oil shortage amount determination map and an oil level lowering determination program which will become apparent as the description proceeds.

The RAM 51*b* is constructed with a work area for temporally storing various data. The ROM 51 is adapted to store the target rotation speed determination map, the oil shortage amount determination map and the oil level lowering determination program which will also become apparent as the description proceeds.

The input port 51*d* is adapted to be inputted with detected information from the oil pressure sensor 52, the oil temperature sensor 53, and the rotation speed sensor 54, while the output port 51*e* is adapted to output an abnormality signal to an alarming apparatus 55 which will be described hereinafter.

The oil pressure sensor 52 is mounted on the main gallery 32 of the oil supply passage 20 to detect the oil discharge pressure of the oil pump 1 from the pressure of the oil supplied to the main galley 32.

The oil temperature sensor 53 is mounted on the main gallery 32 to detect the temperature of the oil supplied to the main gallery 32.

The rotation speed sensor 54 is adapted to detect the rotation speed of the crankshaft of the internal combustion engine, and the ECU 51 is adapted to calculate the rotation speed (rpm) of the internal combustion engine from the rotation number per unit time of the crank sensor.

The ECU 51 is preliminarily set to have the target rotation speed N3 of the internal combustion engine in response to the switching discharge pressure (for example the points R and S in FIGS. 9, 12) in the area where the increase rate of the oil discharge pressure is largest among the oil discharge pressures in the plurality of stages.

The target rotation speeds N3 of the internal combustion engine corresponding to the switching discharge pressures R, S are different from each other depending upon the temperature of the oil, and the switching discharge pressures R, S and the target rotation speeds N3 of the internal combustion engine are set at each temperature of the oil.

More specifically, the relationship between the rotation speed of the internal combustion engine and the oil discharge pressure is shown in FIG. 9 as being in the high temperature area of the oil temperature (for example, about 110 to 130° C.). FIG. 9 shows an oil pressure property for example at about 130° C. of the oil temperature.

Figure 12:
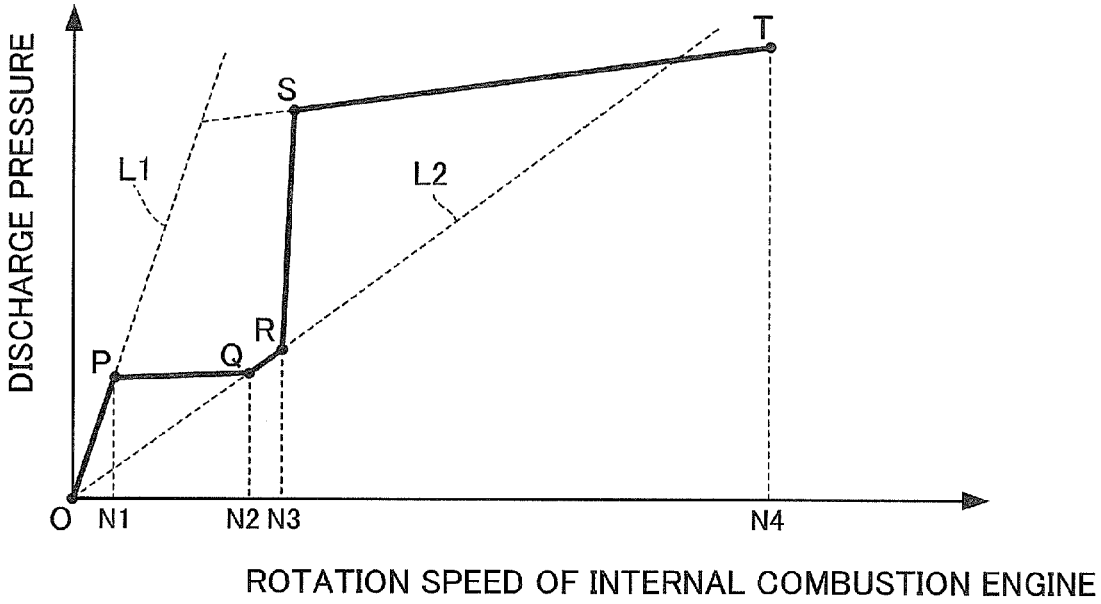
FIG. 12 is one embodiment of the oil supply apparatus of the internal combustion engine according to the present invention, and shows the relationship between the rotation speed of the internal combustion engine with oil temperature in a temperature range commonly used, and an oil discharge pressure.

FIG. 12 is a view showing the relationship between the rotation speed of the internal combustion engine and the oil discharge pressure in the temperature range commonly used of the oil temperature (for example from an ordinary temperature to about 110° C.). FIG. 12 shows an oil pressure property for example at about 80° C. of the oil temperature Here, in the case of the oil temperature high as shown in FIG. 9, the switching discharge pressures R and S having the oil discharge pressure abruptly increased are shifted to the high rotation speed side of the internal combustion engine. The reason is due to the fact that the viscosity of the oil is decreased in response to the increased temperature, and thus a large amount of oil is leaked at the lubrication sections 7 to be supplied with the oil, thereby decreasing the ratio of the increase of the oil discharge pressure with respect to the increase of the rotation speed of the internal combustion engine.

In other words, the reason is due to the fact that a small amount of oil is leaked at the lubrication sections 7 to be supplied with the oil in the case of the viscosity of the oil being high, thereby increasing the ratio of the increase of the oil discharge pressure with respect to the increase of the rotation speed of the internal combustion engine.

The ROM 51*c* of the ECU 51 is adapted to store therein the target rotation speed determination map in which the switching discharge pressures R, S with respect to the temperature of the oil are assigned in response to the target rotation speed N3 of the internal combustion engine, so that the switching discharge pressures R, S can be varied in response to the target rotation speed N3 of the internal combustion engine in accordance with the oil temperature detected by the oil temperature sensor 53 with reference to the target rotation speed determination map.

For this reason, the switching discharge pressures R, S and the target rotation speed N3 of the internal combustion engine in response to the oil temperature is read from the target rotation speed determination map to grasp the operation state of the oil pump 1 for example in the case that the oil temperature is at 130° C.

Further, the relationship among the switching discharge pressures R, S, the target rotation speed N3 of the internal combustion engine, and the oil temperature may be calculated by performing a learning control in accordance with the oil discharge pressure, the oil temperature, and the rotation speed of the internal combustion engine detected during the operation of the internal combustion engine, instead of referring to the map according to the present invention.

The ECU 51 is adapted to determine that the level of oil stored in the oil pan 11 is lowered under the condition that the deviation between the target rotation speed N3 of the internal combustion engine set to correspond to the switching discharge pressure R and the actual rotation speed N of the internal combustion engine actually detected by the oil pressure sensor 52 when the discharge pressure of the supply oil passage 8 reaches the switching discharge pressure R.

In particular, the ECU 51 is adapted to change the data concerning the switching discharge pressures R, S and the target rotation speed N3 associated with each other in accordance with the oil temperature detected by the oil temperature sensor 53. That means the ECU 51 is adapted to read the data regarding the switching discharge pressures R, S and the target rotation speed N3 associated with the oil temperature from the target rotation speed determination map stored in the ROM 51*c*.

The ECU 51 is adapted to determine, with reference to the switching discharge pressure R and the target rotation speed N3 read from the target rotation speed determination map, that the level of oil stored in the oil pan 11 is lowered under the condition that the deviation between the target rotation speed N3 of the internal combustion engine set to correspond to the switching discharge pressure R and the actual rotation speed N of the internal combustion engine is not less than a determination value, and thereafter to output an abnormality signal.

The ROM 51*c* of the ECU 51 is adapted to store therein the oil shortage amount determination map, and to memorize the deviation between the target rotation speed N3 of the internal combustion engine set to correspond to the switching discharge pressure R and the actual rotation speed of the internal combustion engine actually detected by the oil pressure sensor 54 when the discharge pressure of the supply oil passage 8 reaches the switching discharge pressure R, and the oil amount corresponding to the deviation, the deviation being related with the oil amount.

The ECU 51 is adapted to estimate the changing amount of oil stored in the oil pan 11 in accordance with the oil shortage amount determination map, thereby estimating the oil shortage amount of oil stored in the oil pan, viz., the oil shortage amount of oil corresponding to the level decreased from the optimum oil level.

The oil supply apparatus 50 is provided with an alarming apparatus 55 serving as an abnormality alarming unit which is adapted to light and inform a driver of the oil level lowered when receiving an abnormal signal from the ECU 51. The informing method is not limited to the visual alarm such as the above lighting and the like, but may include an auditory alarm caused by buzzer sounds and the like, and a perceivable alarm caused by vibrations according to the present invention.

Figure 13:
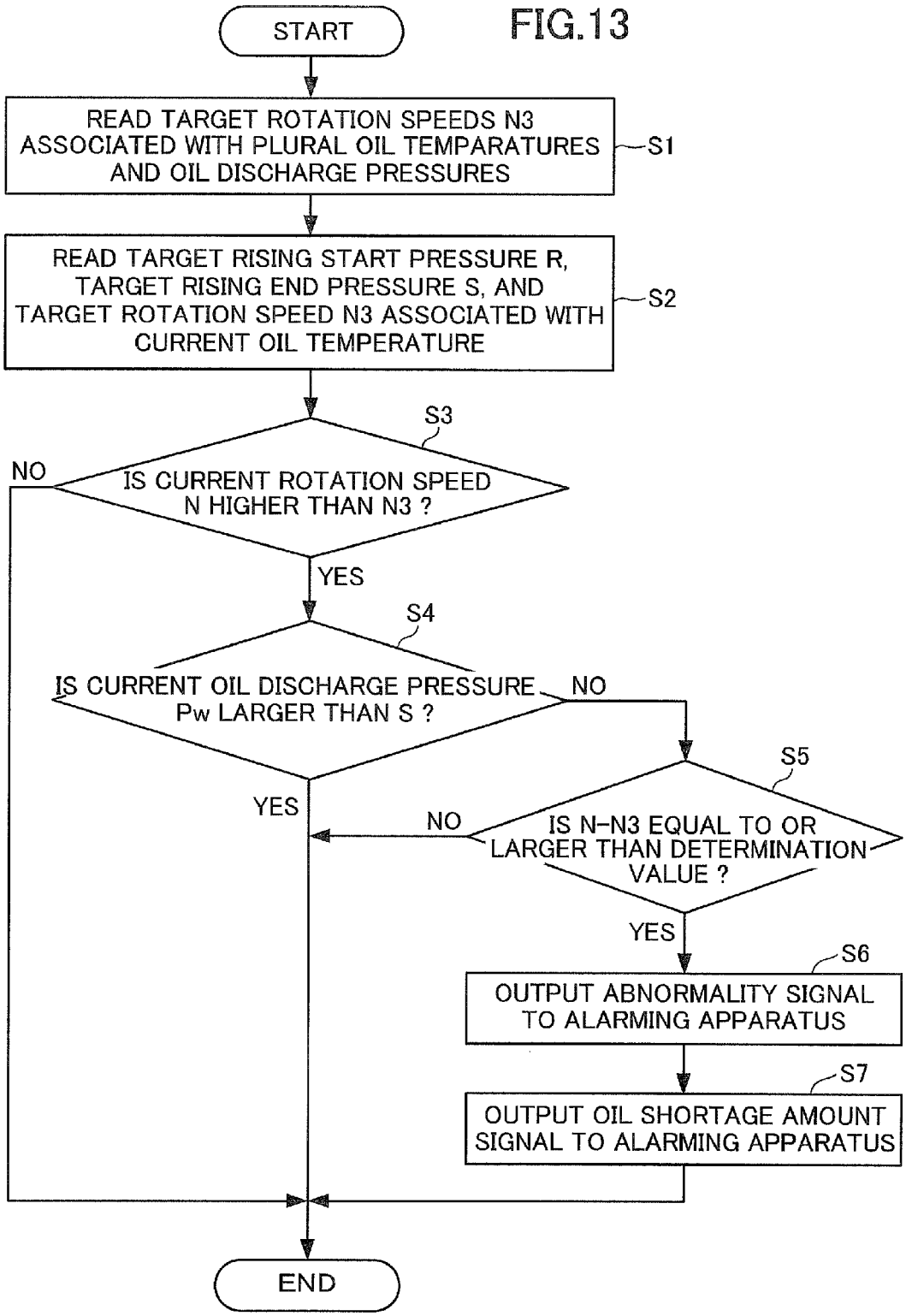
FIG. 13 is one embodiment of the oil supply apparatus of the internal combustion engine according to the present invention, and shows a flow chart for explaining an oil level lowering determination method.

Next, the oil level lowering determination method will be explained with reference to the flow chart shown in FIG. 13. FIG. 13 is a view showing an oil level lowering determination program stored in the ROM 51*c* of ECU 51 which is adapted to perform the oil level lowering determination in accordance with the oil level lowering determination program.

Firstly, the CPU 51*a* refers a target rotation speed determination map stored in the ROM 51*c*, and reads the target rotation speeds N3 associated with a plurality of oil temperatures and the oil discharge pressures in the high temperature range and the temperature range commonly used (Step S1).

Then, the CPU 51*a* refers the target rotation speed determination map stored in the ROM 51*c*, and reads the switching discharge pressures R, S and the target rotation speed N3 of the internal combustion engine associated with the current oil temperature detected by the oil temperature sensor 53 (Step S2).

The following explanation will be made raising an example in which the oil temperature detected by the oil temperature sensor 53 is 130° C. At this time, the switching discharge pressures R, S and the target rotation speed N3 are as shown by a property in FIG. 9. As shown in FIG. 9, the pump 1 is set to be operated to have the oil discharge pressure roughly vertically raised to the switching discharge pressure S when the discharge pressure from the oil pump reaches the switching discharge pressure R. The difference between the rotation speeds at the times of the switching discharge pressures R, S is a small value, e.g., several tens rpm.

The CPU 51*a* is then operated to determine whether or not the actual rotation speed N of the internal combustion engine actually detected in accordance with the detected information from the rotation speed sensor 54 is higher than the target rotation speed N3 (Step S3).

When the CPU 51*a* determines that the actual rotation speed N is equal to or lower than the target rotation speed N3 in Step S3, the CPU 51*a* determines that the actual rotation speed N does not reach the target rotation speed N3, and terminates the current processing.

When the CPU 51*a* determines that the actual rotation speed N is higher than the target rotation speed N3 in Step S3, the CPU 51*a* determines whether or not the current oil pressure Pw is larger than the switching discharge pressure S in accordance with the detected information from the oil pressure sensor 52 (Step S4). The difference between the actual rotation speed N and the target rotation speed N3 is set to be higher than the difference between the rotation speed of the internal combustion engine at the time of the switching discharge pressure R and the rotation speed of the internal combustion engine at the time of the switching discharge pressure S when the actual rotation speed N3 is increased from the switching discharge pressure R.

When the CPU 51*a* determines that the current oil pressure Pw is larger than the switching discharge pressure S in Step S4, the CPU 51*a* determines that the oil is sufficiently stored at the target rotation speed N3 where the oil discharge pressure reaches the switching discharge pressure S by being raised normally from the switching discharge pressure R, and terminates the current processing.

When the CPU 51*a* determines that the current oil pressure Pw is equal to or less than the switching discharge pressure S in Step S4, the CPU 51*a* determines whether or not the deviation between the target rotation speed N3 and the actual rotation speed N at the time of the actual oil discharge pressure becoming the switching discharge pressure R is equal to or larger than the determination value (Step S5).

When the CPU 51*a* determines that the deviation between the target rotation speed N3 and the actual rotation speed N is less than the determination value (Step S5), the CPU 51*a* determines that the deviation between the target rotation speed N3 and the actual rotation speed N at the time of the actual oil discharge pressure becoming the switching discharge pressure R is within the range of error, and terminates the current processing.

The above process indicates that the oil pump 1 is operated to have the discharge pressure promptly raised to the switching discharge pressure S immediately after the actual discharge pressure reaches the switching discharge pressure R at the time of the actual rotation speed N coming to be equal to the target rotation speed N3. This means that the CPU 51*a* determines that the oil is sufficiently stored in the oil pan 11 to have a normal oil level with no air sucked by the oil pump 1.

When, on the other hand, the CPU 51*a* determines that the deviation between the target rotation speed N3 and the actual rotation speed N is equal to or larger than the determination value (Step S5), this determination by the CPU 51*a* indicates that the oil pump 1 is operated to have the discharge pressure raised to the switching discharge pressure S after the actual discharge pressure reaches the switching discharge pressure R at the time of the actual rotation speed N in the rotation speed range higher than the target rotation speed N3. This means that the CPU 51*a* determines that the oil level of the oil stored in the oil pan is lowered, thereby having caused air suction in the oil pump 1.

At this time, CPU 51*a* outputs an abnormality signal to the alarming apparatus 55 (Step S6) which is in turn operated to light for the driver. The lighting of the alarming apparatus 55 informs the driver of a shortage of oil to request the driver to do an oil replenishment work of refilling oil in the oil pan 11.

The CPU 51*a* then refers to the oil shortage amount determination map stored in the ROM 51*c*, and reads the oil shortage amount corresponding to the deviation between the target rotation speed N3 and the actual rotation speed N. The CPU 51*a*, thereafter, outputs an oil shortage signal indicative of the oil shortage amount to the alarming apparatus 55 (Step S7), and terminates the current processing. The alarming apparatus 55 is operated to numerically indicate the oil shortage amount when receiving the oil shortage signal.

The following explanation will be made with reference to FIGS. 14 to 24 about a method of estimating the oil amount corresponding to the deviation between the target rotation speed N3 and the actual rotation speed N.

Figure 14:
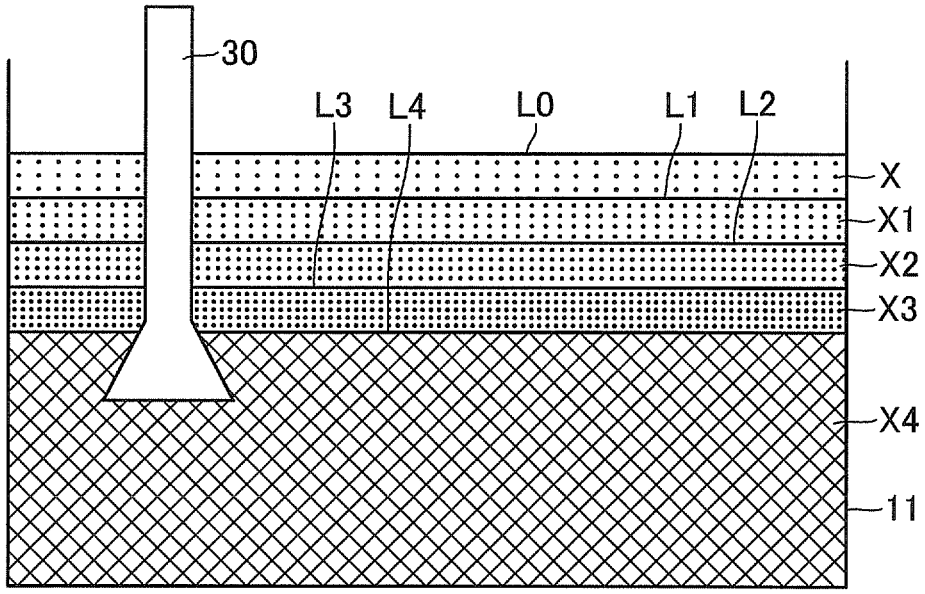
FIG. 14 is one embodiment of the oil supply apparatus of the internal combustion engine according to the present invention, and shows a mixture ratio of an oil amount of oil and bubble stored in an oil pan and the relationship with an oil strainer and an oil level when the oil level is appropriate.
Figure 18:
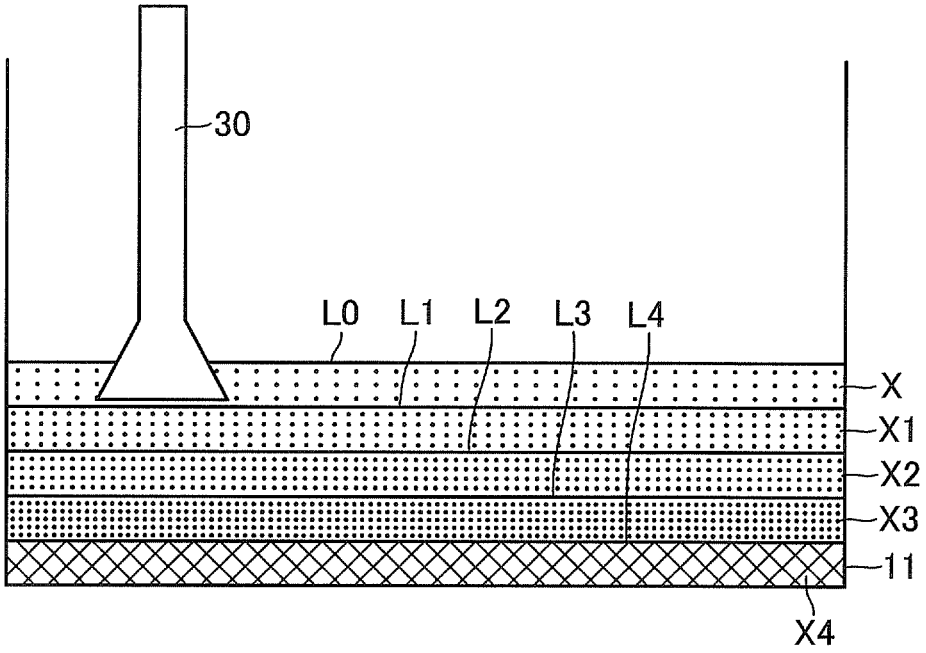
FIG. 18 is one embodiment of the oil supply apparatus of the internal combustion engine according to the present invention, and shows the relationship with an oil strainer and an oil level when the oil level is lowered from the state shown in FIG. 17.

FIGS. 14 to 18 are views respectively showing the mixing percentages of the oil and the bubble mixed and stored in the oil pan 11, and respectively showing states in which the oil levels of the oil stored in the oil pan 11 are lowered step-by-step from FIG. 14 toward FIG. 18.

Figure 19:
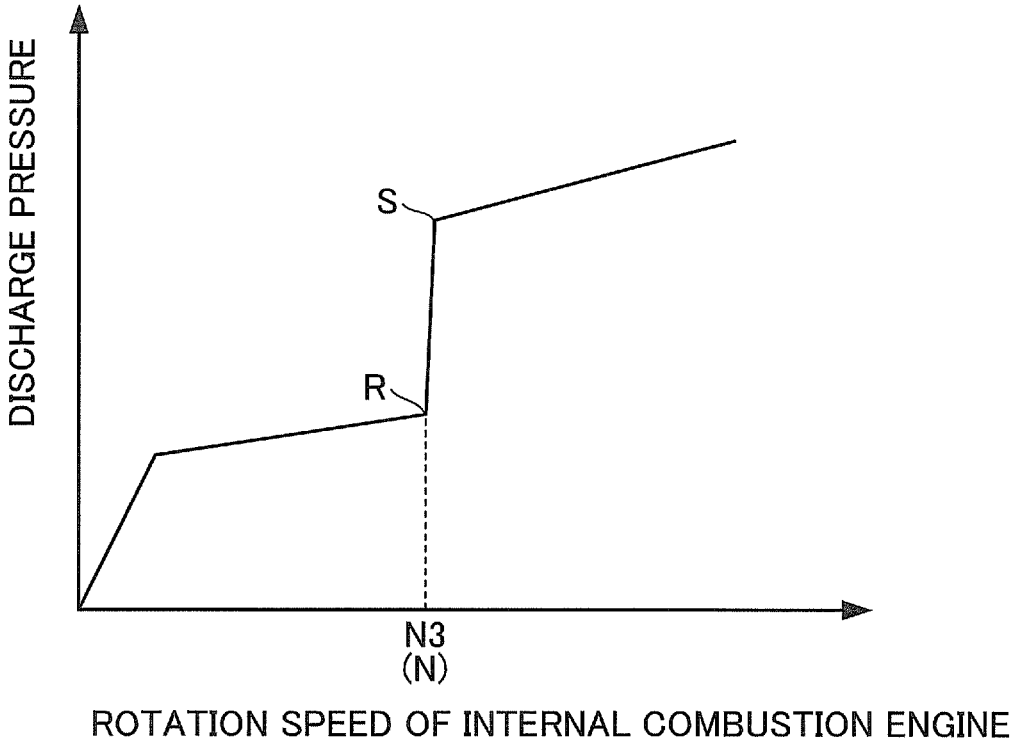
FIG. 19 is one embodiment of the oil supply apparatus of the internal combustion engine according to the present invention, and shows a deviation of a target rotation speed and actual rotation speed in response to the oil level, and a property in response to the oil level in FIG. 14.
Figure 21:
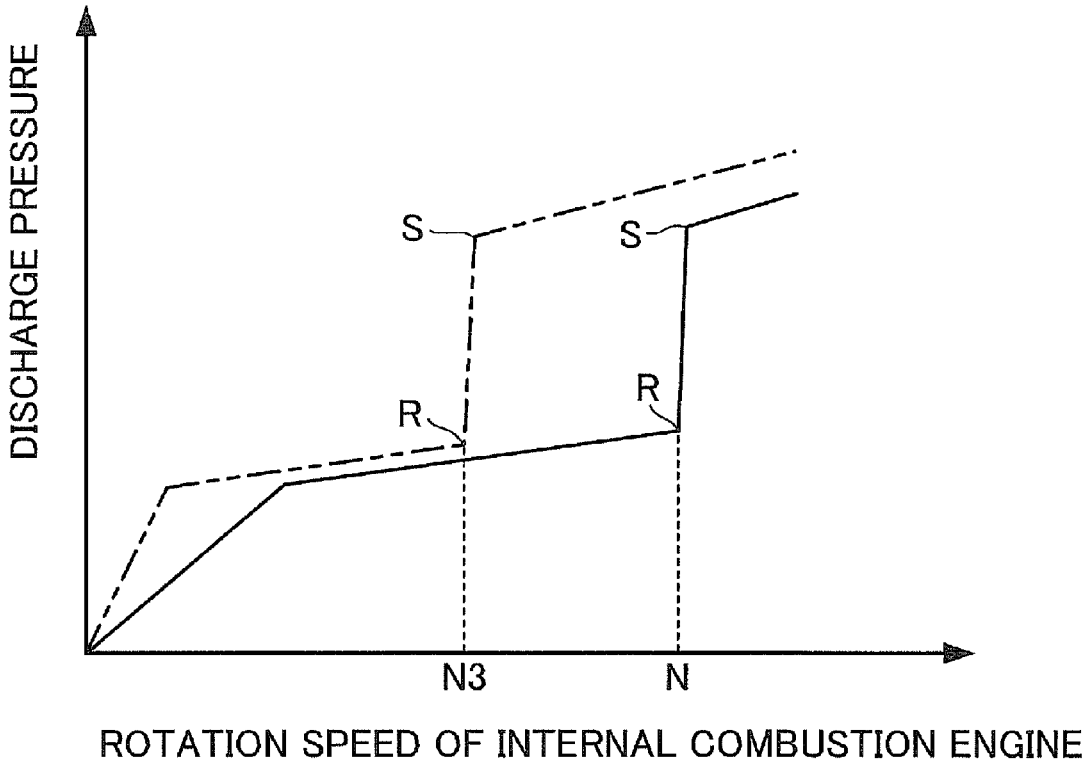
FIG. 21 is one embodiment of the oil supply apparatus of the internal combustion engine according to the present invention, and shows a deviation of a target rotation speed and actual rotation speed in response to the oil level, and a property in response to the oil level in FIG. 16.
Figure 22:
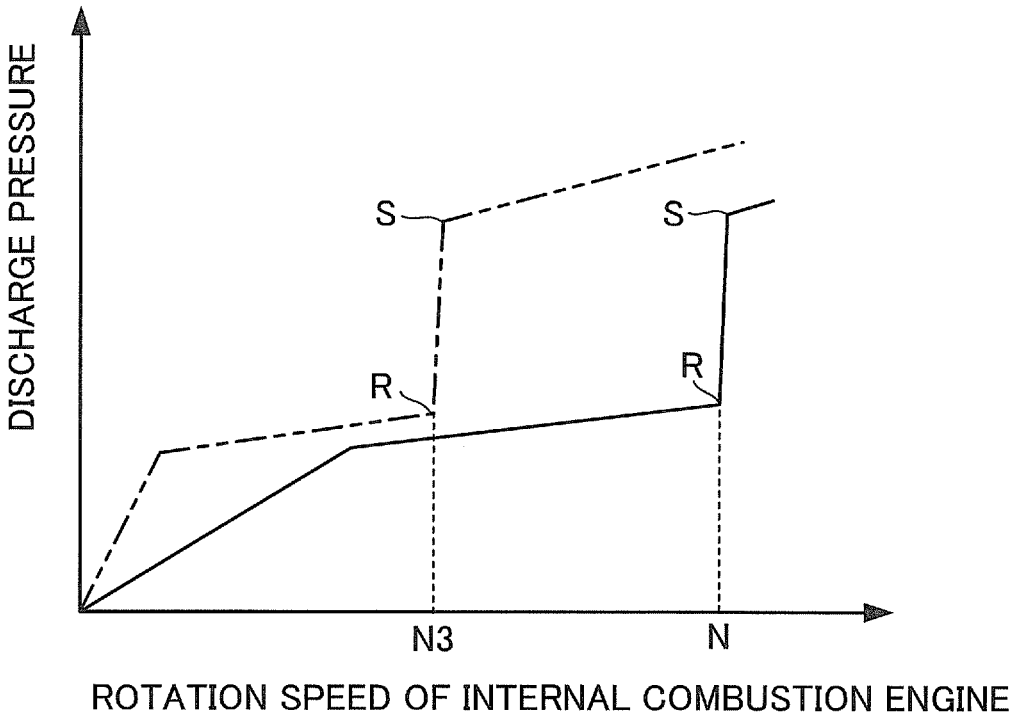
FIG. 22 is one embodiment of the oil supply apparatus of the internal combustion engine according to the present invention, and shows a deviation of a target rotation speed and actual rotation speed in response to the oil level, and a property in response to the oil level in FIG. 17.
Figure 23:
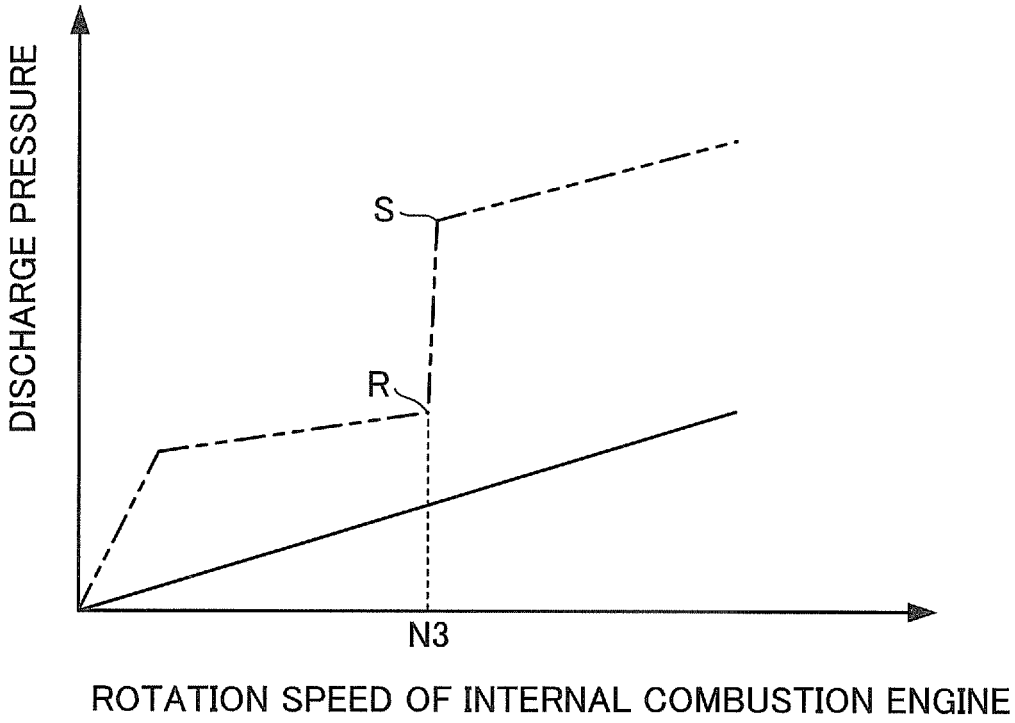
FIG. 23 is one embodiment of the oil supply apparatus of the internal combustion engine according to the present invention, and shows a deviation of a target rotation speed and actual rotation speed in response to the oil level, and a property in response to the oil level in FIG. 18.

FIG. 19 to FIG. 23 are views respectively showing the deviations between the target rotation speeds N3 and the actual rotation speeds N corresponding to the oil levels, and respectively showing states in which the deviations between the target rotation speeds N3 and the actual rotation speeds N are increased from FIG. 19 toward FIG. 23.

When the oil level Lo of the oil stored in the oil pan 11 is maintained at an optimum oil level as shown in FIG. 14, meaning that the oil pan 11 has a sufficient amount of oil reserved therein, the air mixing percentage with respect to the amount of oil between the oil level Lo and the oil level L1 is X %.

The air mixing percentage with respect to the amount of oil between the oil level L1 and the oil level L2 is X1% smaller than X %. Further, the air mixing percentage with respect to the amount of oil between the oil level L2 and the oil level L3 is X2% smaller than X1%.

The air mixing percentage with respect to the amount of oil between the oil level L3 and the oil level L4 is X3% smaller than X2%. Further, the air mixing percentage with respect to the amount of oil below the oil level L4 is X4% smaller than X3%. Here, X4% is equal to zero. As shown in FIGS. 14 to 18, the amount of air mixed with the oil stored in the pan 11 is gradually decreased toward the bottom of the oil pan 11.

When the oil level Lo is maintained at an optimum oil level as shown in FIG. 14, meaning that the oil strainer 30 is soaked below the oil level L4, the air strainer 30 by no means causes any air suction. At this time, the oil property is the same as designed as shown in FIG. 19.

This means the deviation between the target rotation speed N3 and the actual rotation speed N (hereinafter referred to as a limit rotation speed N) at the time of the actual oil discharge pressure becoming the switching discharge pressure R is within the range of error.

Figure 15:
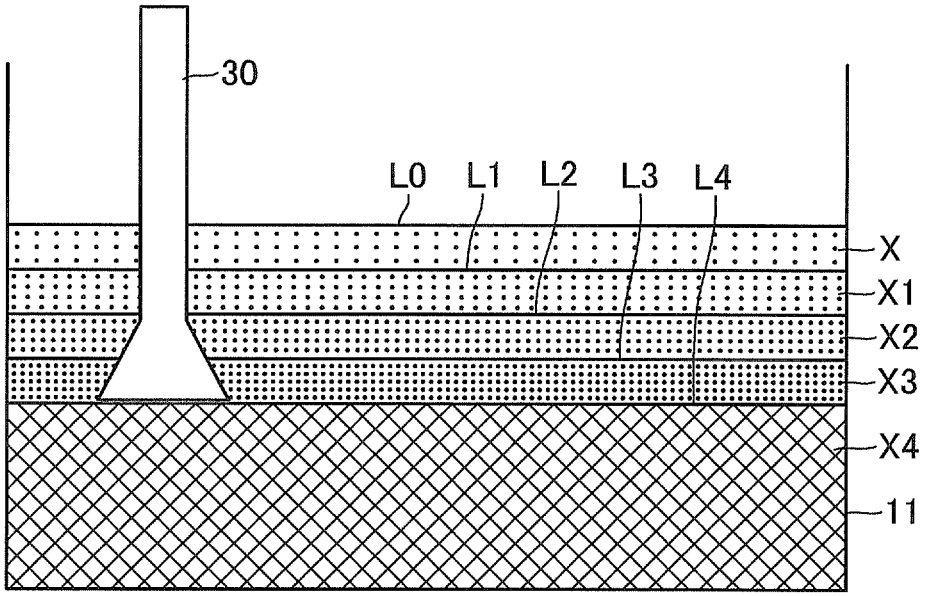
FIG. 15 is one embodiment of the oil supply apparatus of the internal combustion engine according to the present invention, and shows the relationship with an oil strainer and an oil level when the oil level is lowered from the state shown in FIG. 14.
Figure 20:
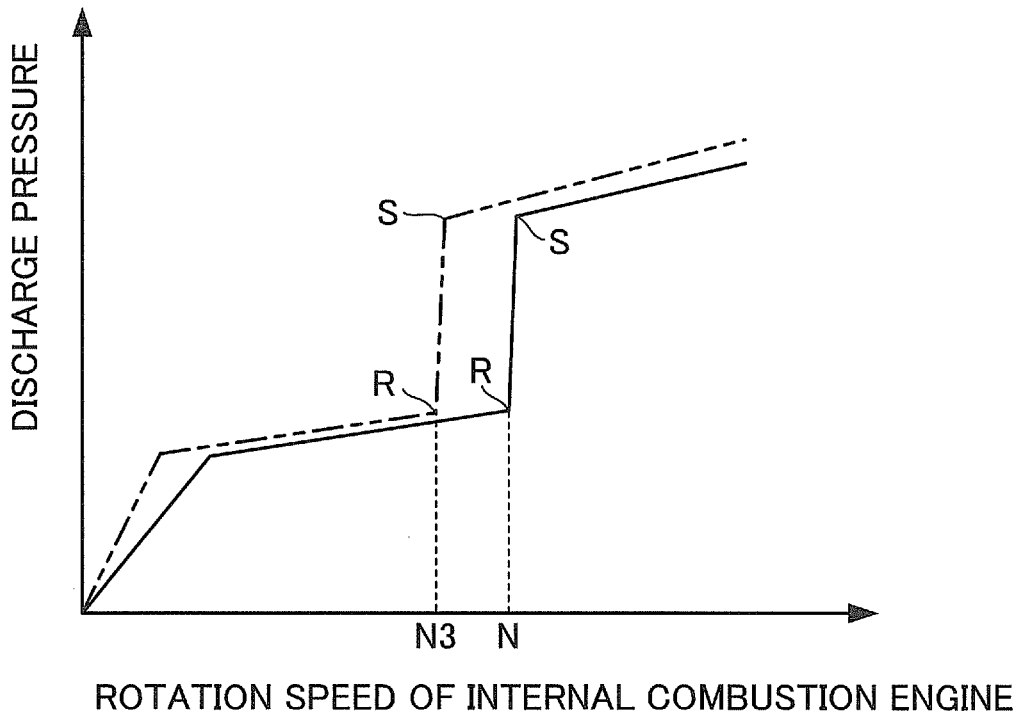
FIG. 20 is one embodiment of the oil supply apparatus of the internal combustion engine according to the present invention, and shows a deviation of a target rotation speed and actual rotation speed in response to the oil level, and a property in response to the oil level in FIG. 15.

When the oil level Lo is lowered below the optimum oil level to have the oil strainer 30 soaked in the range of the oil levels L3 and L4 with the air mixing percentage of X3 as shown in FIG. 15, the air suction is generated in the oil pump 1. For this reason, the limit rotation speed N is shifted to the high rotation speed side over the target rotation speed N3 to allow the deviation between the target rotation speed N3 and the limit rotation speed N to be increased as shown in FIG. 20.

Figure 16:
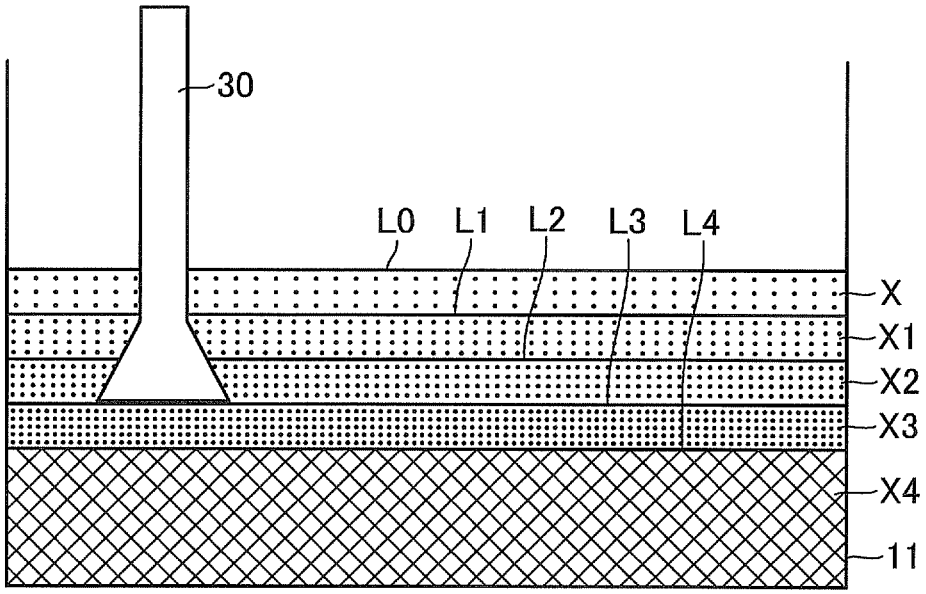
FIG. 16 is one embodiment of the oil supply apparatus of the internal combustion engine according to the present invention, and shows the relationship with an oil strainer and an oil level when the oil level is lowered from the state shown in FIG. 15.
Figure 17:
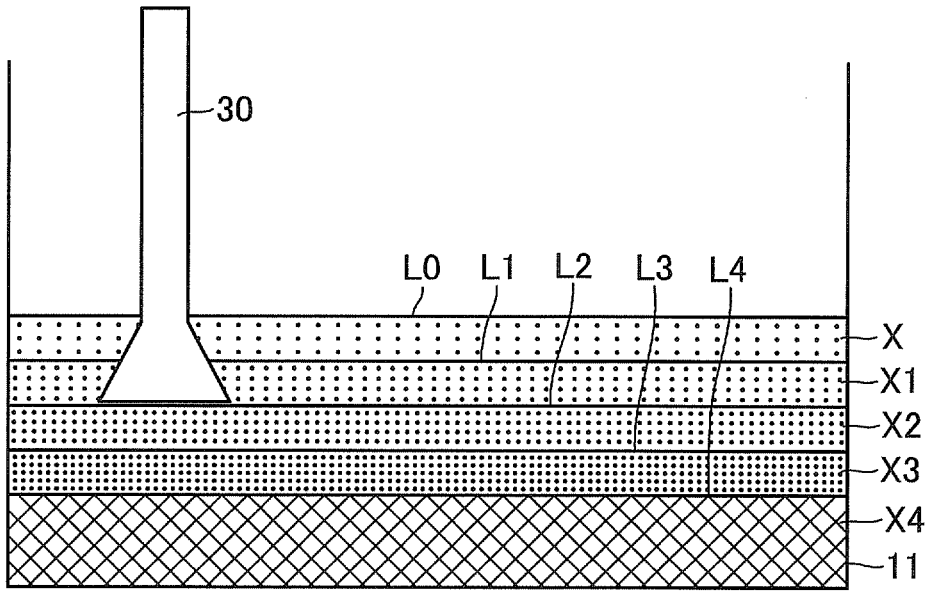
FIG. 17 is one embodiment of the oil supply apparatus of the internal combustion engine according to the present invention, and shows the relationship with an oil strainer and an oil level when the oil level is lowered from the state shown in FIG. 16.

When the oil level Lo is lowered further below the optimum oil level to have the oil strainer 30 soaked in the range of the oil levels L2 and L3 with the air mixing percentage of X2 as shown in FIG. 16, the air suction is further generated in the oil pump 1. For this reason, the limit rotation speed N is further shifted to the high rotation speed side over the target rotation speed N3 to allow the deviation between the target rotation speed N3 and the limit rotation speed N to be further increased as shown in FIG. 21.

When the oil level Lo is lowered still further below the optimum oil level to have the oil strainer 30 soaked in the range of the oil levels L1 and L2 with the air mixing percentage of X1 as shown in FIG. 16, the air suction is still further generated in the oil pump 1. For this reason, the limit rotation speed N is further shifted to the high rotation speed side over the target rotation speed N3 to allow the deviation between the target rotation speed N3 and the limit rotation speed N to be still further increased as shown in FIG. 22. The deviation between the target rotation speed N3 and the limit rotation speed N at this time is corresponding for example to the case in which the oil level is in the red zone.

When the oil level Lo is lowered yet further below the optimum oil level to have the oil strainer 30 soaked in the range of the oil levels Lo and L1 with the air mixing percentage of X as shown in FIG. 18, the oil discharge pressure is not raised to the switching discharge pressure R, and thus below the switching discharge pressure S as shown in FIG. 18.

Figure 24:
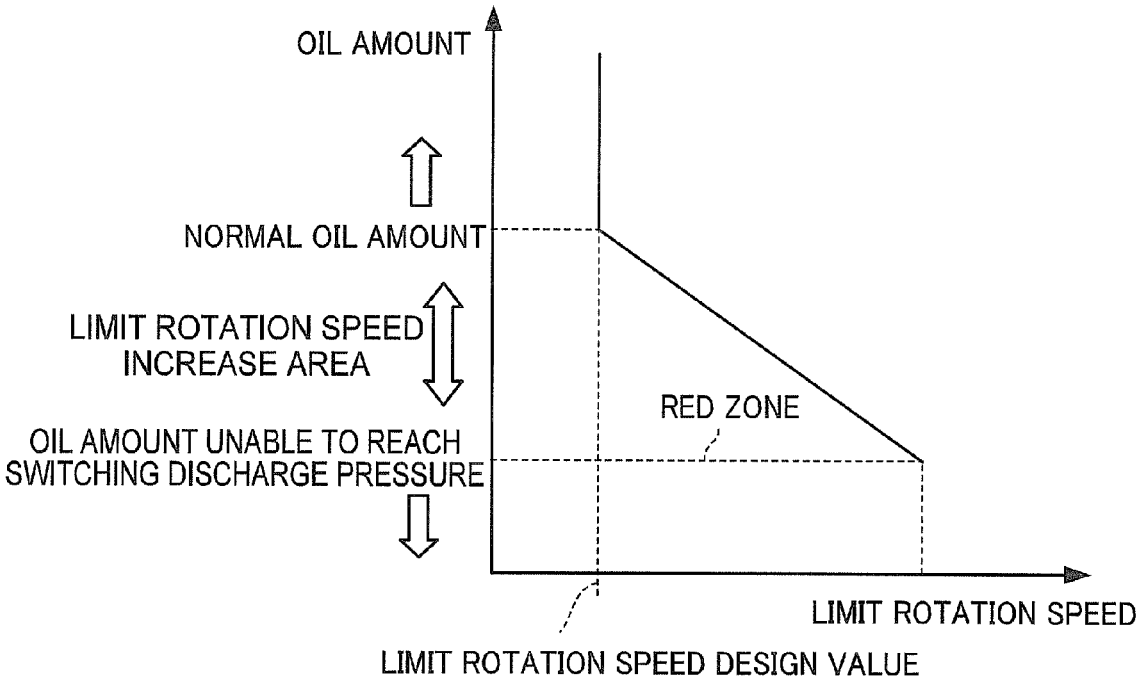
FIG. 24 is one embodiment of the oil supply apparatus of the internal combustion engine according to the present invention, and shows the relationship with an oil amount of oil stored in the oil pan and a limit rotation speed at which the oil pump is changed in discharge pressure.

As shown in FIG. 24, the amount of oil stored in the oil pan 11 and the limit rotation speed N are in correlation with each other, and thus the limit rotation speed N is linearly varied with decreasing of the amount of oil.

The deviation between the target rotation speed N3 and the actual rotation speed N and the variation amount of oil stored in the oil pan 11 is in correlation with each other. The oil shortage amount determination map is prepared to have the deviation between the target rotation speed N3 and the actual rotation speed N associated with the variation amount of oil stored in the oil pan 11.

As will be understood from the foregoing description, the oil supply apparatus 50 according to the present embodiment is provided with an oil pump 1 which is set to have a plurality of switching discharge pressures P, Q, R, S at which the oil discharge pressures are changed for each of the target rotation speeds N1, N2, N3 when the rotation speed of the internal combustion engine reaches the target rotation speeds N1, N2, N3, N4, respectively. The ECU 51 is adapted to determine that the level of oil stored in the oil pan 11 is lowered under the condition that the deviation between the target rotation speed N3 of the internal combustion engine set to correspond to the switching discharge pressure R and the actual rotation speed N of the internal combustion engine actually detected when the discharge pressure reaches the switching discharge pressure R is not less than the determination value.

When the ECU 51 determines the deviation between the target rotation speed N3 of the internal combustion engine set to correspond to the switching discharge pressure R and the actual rotation speed N of the internal combustion engine actually detected when the discharge pressure reaches the switching discharge pressure R is less than the determination value, the ECU 51 determines that the actual rotation speed N is a rotation speed within the range of error in the vicinity of the target rotation speed N3, thereby making it possible for the ECU 51 to determine that the actual oil discharge pressure is increased from the switching discharge pressure R to the switching discharge pressure S.

For this reason, the oil pump 1 can promptly raise the oil discharge pressure from the switching discharge pressure R to the switching discharge pressure S when the internal combustion engine is in the high rotation area, thereby making it possible to supply a sufficient amount of oil to the oil jet 46 and to sufficiently lubricate the piston.

The ECU 51 is adapted to determine that the oil discharge pressure is lowered due to the air suction caused, and thus the level of oil stored in the oil pan 11 is lowered when the actual rotation speed N is increased to the high rotation speed faster than the target rotation speed N3 in the case that the deviation between the target rotation speed N3 of the internal combustion engine set to correspond to the switching discharge pressure R and the actual rotation speed N of the internal combustion engine actually detected when the discharge pressure reaches the switching discharge pressure R is not less than the determination value.

As a consequence, the oil supply apparatus 50 according to the present embodiment can require no oil level sensor which is expensive, as well as can dispense with an oil inspection work by the driver which is needed for the conventional oil supply apparatus. Additionally, the oil supply apparatus 50 is inexpensive in construction and can reliably detect the lowering of the oil level in the oil pan.

Further, the oil supply apparatus 50 according to the present embodiment is provided with an oil pressure sensor 52 for detecting the discharge pressure of the oil discharged from the oil pump 1 and a rotation speed sensor 54 for detecting the rotation speed of the internal combustion engine, thereby making it possible for the ECU 51 to reliably grasp the discharge pressure of the oil discharged from the oil pump 1 and the rotation speed of the internal combustion engine in accordance with the detection information from the oil pressure sensor 52 and the rotation speed sensor 54.

Further, the ECU 51 according to the present embodiment is operative to output the abnormality signal to the alarming apparatus 55 under the condition that the ECU 51 determines the shortage of the oil stored in the oil pan 11, and to have the alarming apparatus 55 issue an alarm, thereby making it possible to alarm the driver of the oil shortage and to request the driver to do the oil replenishment work of refilling oil in the oil pan 11.

In this way, the driver can recognize the oil shortage in the oil pan 11, so that the oil supply apparatus 50 according to the present embodiment not only can prevent the internal combustion engine from being driven in the oil shortage state, but also can prevent the lubrication capability to the lubrication sections 7 from being deteriorated.

The ECU 51 according to the present embodiment is adapted to estimate the amount of oil to be discharged from the oil pump 1 in response to the deviation between the target rotation speed set to correspond to the switching discharge pressure R and the actual rotation speed of the internal combustion engine actually detected when the discharge pressure reaches the switching discharge pressure R. As a consequence, the oil supply apparatus 50 according to the present embodiment can require no oil level sensor which is expensive, as well as can dispense with an oil inspection work by the driver which is needed for the conventional oil supply apparatus. Additionally, the oil supply apparatus 50 can reliably detect the lowering of the oil level in the oil pan 11.

Further, the oil supply apparatus 50 according to the present embodiment has an oil temperature sensor 53 for detecting the temperature of the oil discharged from the oil pump 1, and is adapted to have the switching discharge pressures R, S varied in response to the target rotation speed N3 of the internal combustion engine in accordance with the temperature of the oil discharged from the oil pump 1.

For this reason, the ECU 51 can set the optimum switching discharge pressure R in response to the target rotation speed N3 of the internal combustion engine in accordance with the temperature of the oil discharged from the oil pump 1, and can detect with a high accuracy the deviation between the target rotation speed N3 set to correspond to the switching discharge pressure R and the actual rotation speed N of the internal combustion engine detected when the discharge pressure reaches the switching discharge pressure R. As a consequence, the ECU 51 can determine the lowering of the oil level with a high accuracy.

Further, the ECU 51 according to the present embodiment is adapted to calculate the switching discharge pressure R and the target rotation speed N3 in accordance with the detection information from the oil temperature sensor 53, and to determine the lowering of the level of oil stored in the oil pan 11 under the condition that the deviation between the target rotation speed N3 of the internal combustion engine set to correspond to the switching discharge pressure R and the actual rotation speed N of the internal combustion engine actually detected when the discharge pressure reaches the switching discharge pressure R is not less than the determination value.

For this reason, the ECU 51 can detect with a high accuracy the deviation between the target rotation speed N3 of the internal combustion engine set to correspond to the switching discharge pressure R and the actual rotation speed N of the internal combustion engine actually detected when the discharge pressure reaches the switching discharge pressure R. This results in the fact that the ECU 51 can determine the lowering of the oil level with a high accuracy.

Further, the ECU 51 according to the present embodiment may be adapted to determine the lowering of the level of oil stored in the oil pan 11 under the condition that the deviation between the target rotation speed of the internal combustion engine set to correspond to the switching discharge pressure S and the actual rotation speed N of the internal combustion engine actually detected when the discharge pressure reaches the switching discharge pressure S is not less than the determination value.

While the above embodiment has been explained about the case that the given switching discharge pressure is set to the switching discharge pressure R, the present invention is not limited to this case, but may set either one of the switching discharge pressures P, Q, T as the given switching discharge pressure.

As will be understood from the foregoing description, the oil supply apparatus of the internal combustion engine according to the present invention is of such advantageous effects that the lowering of the level of oil stored in the oil reservoir unit can reliably be detected with an inexpensive construction. Further, the oil supply apparatus of the internal combustion engine according to the present invention is useful as an oil supply apparatus that is constructed to supply the oil to the lubrication sections of the internal combustion engine of the vehicles and to lubricate and cool the lubrication sections.

REFERENCE SIGNS LIST

1: oil pump (pump unit)
11: oil pan (oil reservoir unit)
20: oil supply passage
50: oil supply apparatus

51: ECU (abnormality determination unit)
51*a*: CPU
51*b*: RAM
52: oil pressure sensor (discharge pressure detection unit)
53: oil temperature sensor (oil temperature detection unit)
54: rotation speed sensor (rotation speed detection unit)
55: alarming apparatus (abnormality alarming unit)

The invention claimed is:

1. An oil supply apparatus for use with an internal combustion engine having a plurality of lubrication sections, the oil supply apparatus comprising:

an oil reservoir unit configured to store oil;

an oil supply passage configured to: (i) supply oil stored in the oil reservoir unit to the plurality of lubrication sections, and (ii) recover the oil from the plurality of lubrication sections into the oil reservoir unit;

a pump unit configured to discharge the oil stored in the oil reservoir unit to the oil supply passage, the pump unit having a plurality of different stages of oil discharge pressure varied in an increase amount of oil discharge pressure of the pump unit per the rotation speed of the internal combustion engine in response to the rotation speed area of the internal combustion engine, the pump unit having a plurality of switching discharge pressures each changed for each of a plurality of target rotation speeds when the rotation speeds of the internal combustion engine reach the plurality of target rotation speeds, respectively;

a discharge pressure detection unit configured to detect the oil discharge pressure discharged from the pump unit;

a rotation speed detection unit configured to detect the rotation speed of the internal combustion engine; and an abnormality determination unit configured to set in advance the target rotation speed corresponding to an arbitrary switching discharge pressure selected from among the plurality of switching discharge pressures, and to determine that the level of oil stored in the oil reservoir unit is lowered under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is equal to or greater than a determination value, wherein the abnormality determination unit is configured to:

determine that the level of oil stored in the oil reservoir unit is lowered based on the detection information from the discharge pressure detection unit and the rotation speed detection unit under the condition that the deviation between: (a) the target rotation speed of the internal combustion engine set to correspond to the arbitrary switching discharge pressure, and (b) the actual rotation speed of the internal combustion engine actually detected when the oil discharge pressure reaches the arbitrary switching discharge pressure, is not less than a determination value, and estimate the variable amount of oil stored in the oil reservoir unit based on the deviation between the target rotation speed of the internal combustion engine and the actual rotation speed of the internal combustion engine.

2. The oil supply apparatus as set forth in claim 1, the oil supply apparatus further comprising:

an abnormality alarming unit configured to receive an abnormality signal outputted from the abnormality determination unit under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value, and the abnormality alarming unit is operative to issue an alarm when receiving the abnormality signal from the abnormality determination unit.

3. The oil supply apparatus as set forth in claim 1, the oil supply apparatus further comprising:

an oil temperature detection unit configured to detect the temperature of oil discharged from the pump unit, the abnormality determination unit is configured to change the arbitrary switching discharge pressure in response to the target rotation speed of the internal combustion engine in accordance with the temperature of oil discharged from the pump unit.

4. The oil supply apparatus as set forth in claim 3, wherein the abnormality determination unit is configured to:

(i) calculate the arbitrary switching discharge pressure and the target rotation speed corresponding to the arbitrary switching discharge pressure in accordance with the detection information from the oil temperature detection unit, and (ii) determine that the level of oil stored in the oil reservoir unit is lowered under the condition that the deviation between the target rotation speed of the internal combustion engine set to correspond to the arbitrary switching discharge pressure and the actual rotation speed of the internal combustion engine actually detected when the oil discharge pressure reaches the arbitrary switching discharge pressure is not less than a determination value.

* * * * *